US008666733B2

(12) United States Patent
Toraichi et al.

(10) Patent No.: US 8,666,733 B2
(45) Date of Patent: Mar. 4, 2014

(54) AUDIO SIGNAL COMPRESSION AND DECODING USING BAND DIVISION AND POLYNOMIAL APPROXIMATION

(75) Inventors: Kazuo Toraichi, Tsukuba (JP); Mitsuteru Nakamura, Tsukuba (JP); Yasuo Morooka, Hitachi (JP)

(73) Assignee: Japan Science and Technology Agency, Kawaguchi-Shi (JP)

( * ) Notice: Subject to any disclaimer, the term of this patent is extended or adjusted under 35 U.S.C. 154(b) by 555 days.

(21) Appl. No.: 12/997,252

(22) PCT Filed: Jun. 3, 2009

(86) PCT No.: PCT/JP2009/060110

§ 371 (c)(1), (2), (4) Date: Dec. 10, 2010

(87) PCT Pub. No.: WO2009/157280

PCT Pub. Date: Dec. 30, 2009

(65) Prior Publication Data

US 2011/0106547 A1 May 5, 2011

(30) Foreign Application Priority Data

Jun. 26, 2008 (JP) ..... 2008-167143
Jun. 26, 2008 (JP) ..... 2008-167144
Jun. 26, 2008 (JP) ..... 2008-167145

(51) Int. Cl.
*G10L 21/00* (2013.01)
*G10L 25/90* (2013.01)
*G10L 19/00* (2013.01)

(52) U.S. Cl.
USPC ..... 704/206; 704/205; 704/201

(58) Field of Classification Search
USPC ..... 704/200–232
See application file for complete search history.

(56) References Cited

U.S. PATENT DOCUMENTS 4,852,129 A * 7/1989 Schwartz ..... 375/240
5,054,075 A * 10/1991 Hong et al. ..... 704/226
5,699,479 A * 12/1997 Allen et al. ..... 704/205

(Continued)

FOREIGN PATENT DOCUMENTS

JP 2001-521648 11/2001
JP 2005-57439 3/2005

(Continued)

OTHER PUBLICATIONS

International Search Report for International Application No. PCT/JP2009/060110, Jul. 7, 2009.

(Continued)

*Primary Examiner* — Jesse Pullias
(74) *Attorney, Agent, or Firm* — Ditthavong Mori & Steiner, P.C.

(57) ABSTRACT

When encoding an audio signal, it is possible to efficiently encode the audio signal while maintaining high register signal components, and prevent deterioration of sound quality of decoded signal. A digital audio signal is divided into a plurality of frequency bands. The digital audio signal having been divided into each band is function-approximated for each divided band. Further, parameters of function having been function-approximated are encoded. When performing decoding process, parameters of the function of each band are used to perform function interpolation, synthesize the function-interpolated signal of each band interpolated, and decode the signal. Thus, when function-approximating each band, by suitably setting the function equation, it is possible to perform an encoding process while maintaining the high register components and perform a compression-coding process which enables reproduction with very good sound quality.

16 Claims, 21 Drawing Sheets

| BANK NUMBER | FUNCTION FORM | ORDER | SHIFT AMOUNT | BIT-WIDTH | COEFFICIENT VALUE | SHIFT AMOUNT | BIT-WIDTH | COEFFICIENT VALUE | SHIFT AMOUNT | BIT-WIDTH | COEFFICIENT VALUE | SHIFT AMOUNT | BIT-WIDTH | COEFFICIENT VALUE | SHIFT AMOUNT | BIT-WIDTH | COEFFICIENT VALUE |
|---|---|---|---|---|---|---|---|---|---|---|---|---|---|---|---|---|---|
| 6 | 1 | 3 | 2 | 2 | 0~16 | 2 | 2 | 0~16 | 2 | 2 | 0~16 | 2 | 2 | 0~16 | 2 | 2 | 0~16 |

| ITEM | BIT NUMBER | EXPLANATION |
|---|---|---|
| BANK NUMBER | 6 | 0~127<br>BANK NUMBER OF BAND DIVIDING FILTER |
| FUNCTION FORM | 1 | 0 : SAMPLING FUNCTION APPROXIMATION<br>1 : POLYNOMIAL FUNCTION APPROXIMATION |
| ORDER | 3 | WHEN FUNCTION FORM IS 0: MAXIMUM OF TIMES (m-1) BY WHICH THE SAMPLING FUNCTION CAN BE DIFFERENTIATED<br>WHEN FUNCTION FORM IS IS 1: MAXIMUM DEGREE OF POLYNOMIAL |
| SHIFT AMOUNT | 2 | 0 : NO SHIFT<br>1 : 8-BITS SHIFTED<br>2 : 16-BITS SHIFTED<br>3 : 32-BITS SHIFTED |
| BIT-WIDTH | 2 | 0 : 4BITS 1:8BITS 2:12BITS 3:16BITS |
| COEFFICIENT VALUE | 0~16 | COEFFICIENT VALUE |

| | | | | | | | | | | | | | | | | |
|---|---|---|---|---|---|---|---|---|---|---|---|---|---|---|---|---|
| 0A | 1 | 4 | 3 | 3 | 447C | 3 | 1 | 50 | 2 | 2 | 2A1 | 2 | 0 | F | 0 | 2 | 13E |

(56) References Cited

U.S. PATENT DOCUMENTS

| | | | | |
|---|---|---|---|---|
| 5,886,276 | A * | 3/1999 | Levine et al. | 84/603 |
| 6,704,705 | B1 * | 3/2004 | Kabal et al. | 704/230 |
| 7,593,851 | B2 * | 9/2009 | Yang | 704/228 |
| 2003/0236675 | A1 * | 12/2003 | Duan | 704/500 |
| 2004/0078194 | A1 | 4/2004 | Liljeryd et al. | |
| 2005/0165611 | A1 | 7/2005 | Mehrotra et al. | |
| 2006/0074693 | A1 | 4/2006 | Yamashita | |

FOREIGN PATENT DOCUMENTS

| | | |
|---|---|---|
| JP | 2007-249009 | 9/2007 |
| WO | WO 2005/004113 | 1/2005 |

OTHER PUBLICATIONS

Veldhuis et al., "Subband Coding of Digital Audio Signals Without Loss of Quality", International Conference Acoustics, Speech, and Signal Processing (ICASSP), May 23, 1989, pp. 2009-2012, XP010082690.

Pilati et al., "Enhancements to the SBC CODEC for voice communication in Bluetooth devices", AES Convention 124, May 2008, XP040508563.

Extended European Search Report for corresponding EP Application No. 09769990.4-2225, Jun. 19, 2012.

* cited by examiner

FIG. 3

| BANK NUMBER | FUNCTION FORM | ORDER | SHIFT AMOUNT | BIT-WIDTH | COEFFICIENT VALUE | SHIFT AMOUNT | BIT-WIDTH | COEFFICIENT VALUE | SHIFT AMOUNT | BIT-WIDTH | COEFFICIENT VALUE | SHIFT AMOUNT | BIT-WIDTH | COEFFICIENT VALUE | SHIFT AMOUNT | BIT-WIDTH | COEFFICIENT VALUE |
|---|---|---|---|---|---|---|---|---|---|---|---|---|---|---|---|---|---|
| 6 | 1 | 3 | 2 | 2 | 0~16 | 2 | 2 | 0~16 | 2 | 2 | 0~16 | 2 | 2 | 0~16 | 2 | 2 | 0~16 |

| ITEM | BIT NUMBER | EXPLANATION |
|---|---|---|
| BANK NUMBER | 6 | 0~127<br>BANK NUMBER OF BAND DIVIDING FILTER |
| FUNCTION FORM | 1 | 0 : SAMPLING FUNCTION APPROXIMATION<br>1 : POLYNOMIAL FUNCTION APPROXIMATION |
| ORDER | 3 | WHEN FUNCTION FORM IS 0: MAXIMUM OF TIMES (m-1) BY WHICH THE SAMPLING FUNCTION CAN BE DIFFERENTIATED<br>WHEN FUNCTION FORM IS IS 1: MAXIMUM DEGREE OF POLYNOMIAL |
| SHIFT AMOUNT | 2 | 0 : NO SHIFT<br>1 : 8-BITS SHIFTED<br>2 : 16-BITS SHIFTED<br>3 : 32-BITS SHIFTED |
| BIT-WIDTH | 2 | 0 : 4BITS 1:8BITS 2:12BITS 3:16BITS |
| COEFFICIENT VALUE | 0~16 | COEFFICIENT VALUE |

| | | | | | | | | | | | | | | | | | |
|---|---|---|---|---|---|---|---|---|---|---|---|---|---|---|---|---|---|
| 0A | 1 | 4 | 3 | 3 | 447C | 3 | 1 | 50 | 2 | 2 | 2A1 | 2 | 0 | F | 0 | 2 | 13E |

AUDIO SIGNAL COMPRESSION AND DECODING USING BAND DIVISION AND POLYNOMIAL APPROXIMATION

TECHNICAL FIELD

The present invention relates to an audio signal compression device and an audio signal compression method for efficiently compressing audio signal, as well as an audio signal decoding device (i.e., audio signal demodulation device) and an audio signal decoding method (i.e., an audio signal demodulation method) for decoding the compressed audio signal.

BACKGROUND ART

Conventionally, various encoding methods for compression-coding digital audio signal have been put into practical use. To be specific, when converting an analog audio signal to a digital audio signal, typically a predetermined number of bits of data are sampled every constant sampling period, so that a digital audio signal is generated. Further, a predetermined number of bits of data are compression-coded every constant sampling period by various compression methods suitable for the audio signal.

For example, there is an art in which a digital audio signal obtained by sampling an analog audio signal within an audible frequency band from 20 Hz to 20 kHz is divided into a predetermined number of bands, and various kinds of arithmetic processing for reducing amount of data, such as discrete cosine transform, are performed on each of the divided bands to encode the signal. Such process has been put into practical use as a compressed audio format such as MP3 (MPEG Audio Layer-3).

Patent document 1 discloses an example of this kind of audio signal encoding process.

[Patent document 1] International Publication (laid-open) No. 2005/004113 pamphlet

DISCLOSURE OF THE INVENTION

Problems to be Solved by the Invention

When efficiently compression-coding a digital audio signal, a process of dividing the audio signal into a plurality of bands as described above may be performed. However, a digital filter for extracting signal components of the corresponding audio frequency band is typically used to perform the process of dividing the audio signal into the plurality of bands.

For example, as shown in FIG. 24, the digital audio signal is divided in the order from low frequency to high frequency: a first band B1, a second band B2, a third band B3, . . . . At this time, in the case of performing a conventional filter processing, the width of attenuation band of the filter will become large, and there will be a signal-overlapped part between adjacent bands as shown in FIG. 24. In other words, the same signal component will be included both as the highest frequency signal component of the first band B1 and as the lowest frequency signal component of the second band B2. The same goes for the other adjacent bands. If there are such overlapped parts between adjacent bands, when playing the demodulated and synthesized signal, the overlapped signal components will cause degradation of the reproduced sound.

Further, in the case where the audio signal is compression-coded using a compression method with relatively high compression rate such as MP3, the sound quality after being decoded will deteriorate regardless of the kind of the encoding method. The problem of sound quality deterioration is an unavoidable problem as long as reversibility when performing compression and decoding is not maintained, and the higher the compression rate is, the more seriously the quality of the reproduced sound will deteriorate. This is because if the compression rate is higher, the number of the data to be thinned out will increase when performing encoding process, and therefore the quality of the reproduced sound will deteriorate more seriously.

Particularly, in a conventional compression-coding method, as the band of the audio signal to be encoded, the upper limit frequency on the side of high register range is limited to a certain band, and thereby the amount of data is limited. However, it can be said that limiting the high register signal components will increase the deterioration of the sound quality.

In recent years, as uncompressed digital audio signal (or digital audio signal compressed with a low compression rate), there is a signal system in which, as high register range, a high frequency range up to dozens to 100 kHz, which is far higher than 20 kHz, is recorded for example. The aforesaid signal system will contribute to improvement of the quality of the reproduced sound if a general reproducing system is used. However, when performing compression-coding on the audio signal with high compression rate such as MP3 as described above, since the aforesaid high register sound is completely removed, the aforesaid a signal system will not contribute to improvement of the quality of the reproduced sound.

The present invention has been made in view of the above problems, and it is an object of the present invention to substantially reduce deterioration of the sound quality of the decoded signal by performing an efficient encoding process in which high register signal component is maintained, as well as performing a decoding process corresponding to the encoding process.

Further, it is another object of the present invention to prevent deterioration of sound quality caused by signal overlapping between bands when performing band-dividing and compression-coding on the audio signal.

Means for Solving the Problems

An audio signal compression device according to the present invention includes: a band dividing means adapted to divide a digital audio signal into a plurality of frequency bands; a function approximation means prepared for each divided band and adapted to function-approximate a predetermined interval of the digital audio signal, which has been divided into each band by the band dividing means, using an n-degree polynomial (n is an integral number equal to or more than 2); and an encoding means adapted to encode parameters which are coefficient values of the n-degree polynomial having been function-approximated by the function approximation means.

It is preferred that the audio signal compression device according to the present invention further includes a down-sampling means adapted to thin out a sampling period of the digital audio signal divided into each band by the band dividing means, wherein the function approximation means function-approximates the digital audio signal whose sampling period has been thinned out by the down-sampling means.

Further, in a preferable example of the band dividing means used in the audio signal compression device of the present invention, the band dividing means includes a first band separation filter adapted to separate the signal of a first frequency band of the inputted digital audio signal and a first subtraction means adapted to subtract a signal obtained by function-approximating, with the function approximation means, the signal of the first frequency band separated by the first band separation filter and then function-interpolating the function-approximated signal from the inputted digital audio signal. The band dividing means further includes a second band separation filter adapted to separate the signal of a second frequency band from the output of the first subtraction means and a second subtraction means adapted to subtract a signal obtained by function-approximating, with the function approximation means, the signal of the second frequency band separated by the second band separation filter and then function-interpolating the function-approximated signal from the output signal of the first subtraction means. The signal of a third frequency band is separated from the output of the second subtraction means. Incidentally, the description is made for the first to third band separation filters herein, in the case where the digital audio signal is divided into n frequency bands, it is possible to separate the digital audio signal into n frequency bands by sequentially using the i-th band separation filter and the i-th subtraction means.

Further, as an example of the audio signal compression device of the present invention, the audio signal compression device includes a plurality of octave separation filters adapted to separate the digital audio signal into each octave frequency band and scale-component separation filters adapted to separate the digital audio signal of each one octave band separated by the plurality of octave separation filters into twelve scales compliant bands corresponding to twelve scales. Further, the audio signal compression device includes a plurality of function approximation means adapted to collect the same scale of the twelve scales compliant bands separated by the scale-component separation filters from a plurality of octaves separated by the octave separation filters to obtain a collection of a band corresponding to the same scale, and function-approximate the collection of the band corresponding to the same scale by an n-degree polynomial (n is an integral number equal to or more than 2), and a compression-coding means adapted to compression-code the signals from the plurality of function approximation means.

Further, the present invention includes an audio signal decoding device corresponding to the audio signal compression devices. Specifically, the audio signal decoding device according to the present invention includes a decoding means adapted to decode parameters of a function of each of a plurality of divided bands of a digital audio signal, wherein the parameters of the function correspond to a compressed digital audio signal which is obtained by: function-approximating a predetermined interval of the digital audio signal divided into the plurality of frequency bands by using an n-degree polynomial (n is an integral number equal to or more than 2), and then encoding and compressing parameters which represent the coefficient values of the n-degree polynomial. The audio signal decoding device according to the present invention further includes a function interpolation means adapted to function-interpolate the compressed digital audio signal based on the parameters of the function of each of the divided bands decoded by the decoding means, and reconstruct sampling values of each of the divided bands, and a band-synthesizing means adapted to band-synthesize the sampling values reconstructed by the function interpolation means.

Further, as a concrete example of the audio signal decoding device of the present invention, there is an audio signal decoding device which is adapted to decode an audio signal compression-coded for each collection of twelve scales compliant bands obtained by collecting, from a plurality of octaves, each twelve scales compliant band of one octave. Such an audio signal decoding device includes: a decoding means adapted to decode each collection of the twelve scales compliant bands; a plurality of function interpolation means adapted to perform function interpolation for each collection of the twelve scales compliant bands decoded by the decoding means; and a synthesizing means adapted to synthesize the collections of twelve scales compliant bands from the function interpolation means and collect digital audio signal for each octave.

Further, the present invention includes an audio signal compression method and an audio signal decoding method respectively correspond to the audio signal compression device and the audio signal decoding device, and the methods are achieved using these devices.

Advantages of the Invention

According to the present invention, it is possible to perform efficient compression-coding by function-approximating the signal of each band-divided band and encoding the parameters of the function of each function-approximated band. Further, in such a case, by suitably setting function expression when function-approximating each band, it is possible to perform encoding process in which high register component is maintained, and achieve compression-coding enabling reproduce with sound quality.

BRIEF DESCRIPTION OF DRAWINGS

FIG. 3 is a view showing the structure of a format of a bit-stream used in the first embodiment of the present invention;

BEST MODES FOR CARRYING OUT THE INVENTION

<Description of First Embodiment>

A first embodiment (also referred to as "present embodiment") of the present invention will be described below with reference to FIGS. 1 to 12F.

First, in the first embodiment of the present invention, an audio signal is efficiently compressed and encoded. Further, the encoded audio signal is decoded.

[Description of Entire Configuration Example of Encoding Device]

First, an example of the entire configuration of an encoding device used in the present embodiment will be described with reference to FIG. 1.

Figure 1:
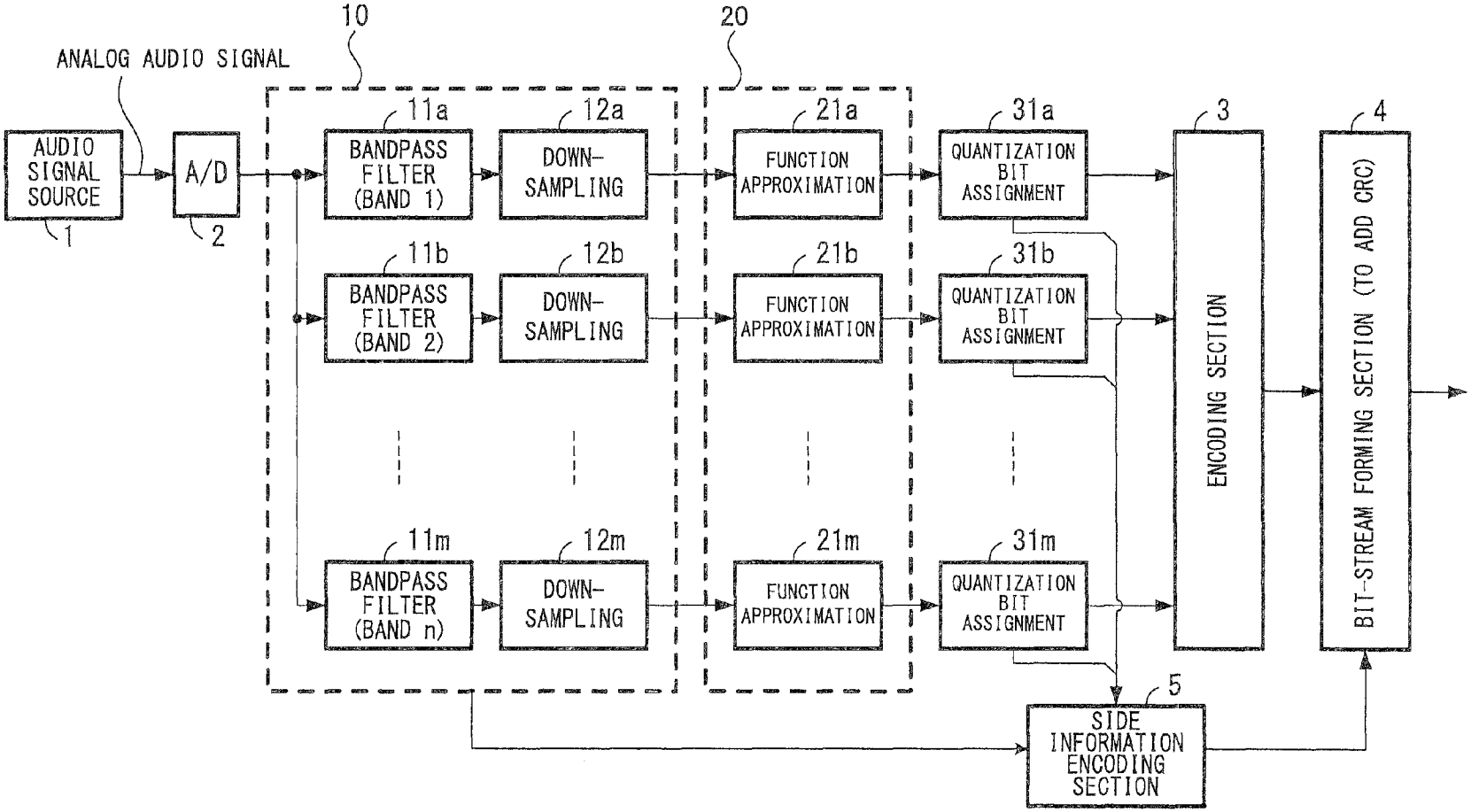
FIG. 1 is a block diagram showing a circuit for performing encoding process used in a first embodiment of the present invention.

As shown in FIG. 1, an analog audio signal is outputted from an audio signal source 1. The analog audio signal is supplied to an analog-to-digital converter 2, where a predetermined number of bits is sampled every constant sampling period, so that the analog audio signal is converted into a digital audio signal.

Incidentally, the digital audio signal converted by the analog-to-digital converter 2 is an uncompressed digital audio signal.

Further, the digital audio signal outputted from the digital-to-analog converter 2 is compression-coded by a filter bank 10 shown in FIG. 1. Incidentally, in the example shown in FIG. 1, the analog audio signal is converted into digital signal; however the present invention also includes a possible configuration in which a digitalized audio signal is prepared to be supplied to a processing system (which is to be described later).

Next, the configuration of the filter bank 10 adapted to perform to compression-coding will be described below. The filter bank 10 is adapted to divide the audio signal into a plurality of bands of signal components.

To be specific, the filter bank 10 has a plurality of bandpass filters 11*a* to 11*m* (m is an arbitrary integral number, and herein m is a number corresponding to a division number), the number of bandpass filters corresponding to the division number, which is a number the frequency band is to be divided into. Each of the bandpass filters 11*a* to 11*m* constitutes a basic filter, which is adapted to perform band-dividing with a sampling function ψ(k), for example, as impulse response function, wherein the sampling function ψ(k) is expressed by a section polynomial. Incidentally, the concrete processing examples of extracting the signal of the frequency band assigned to each of the bandpass filters 11*a* to 11*m* will be described later.

The signal respectively band-divided by the bandpass filters 11*a* to 11*m* are respectively supplied to down-sampling sections 12*a* to 12*m* to be subject to a down-sampling process to thin out the sampling number. In each of the down-sampling sections 12*a* to 12*m*, a process of thinning out the band-divided signals supplied from the bandpass filters 11*a* to 11*m* to a fraction is performed.

The signal down-sampled by each of the down-sampling sections 12*a* to 12*m* is supplied to a function approximation section 20. The function approximation section further includes a plurality of function approximation sections 12*a* to 21*m* for each of the divided bands. Further, in each of the function approximation sections 21*a* to 21*m*, a function approximation process is performed for each band-divided signal. A parameter used for the function approximation process is outputted. Incidentally, a concrete processing example of the function approximation will be described later with reference to FIGS. 7 to 13.

The parameters (which are to be described later) obtained by performing function approximation in the respective bands are supplied to a plurality of quantization bit assignment sections 31*a* to 31*m*, in which quantization bits are assigned in accordance with the value of each parameter.

Details of the quantization bit assignment will be described below. Obviously, quantization means a process of converting analog audio signal values to digital signal values. Typically, in the case of an audio (acoustic) signal, real number values (having numbers after the decimal point) of the analog signal is converted to integer values of ±0~65535 (16 bits).

In the present invention, function-approximated coefficient values in place of the audio signal values are the real number values corresponding to the analog signal values. In other words, the process of converting the coefficient values to the 16-bit digital values means the "quantization" of the present invention. At this time, in the case where a polynomial approximation is performed on the low register signal shown in FIG. 2A, for example, the coefficient values are approximated by an approximate expression defined by Expression 1.

$$y=2\times10^{-5}x^4-0.004x^3+0.0227x^2+21.24x+318.02 \quad \text{[Expression 1]}$$

Here, x represents a sampling number. Since sampling frequency is 44.1 kHz, therefore x=t/(22.7 μs) if the sampling number is converted to time t. Thus, Expression 1 can be rewritten to Expression 2, which is a function of time t.

$$y=(7.53\times10^{13})t^4-(3.42\times10^{11})t^3+(4.41\times10^{7})t^2+(0.9356\times10^{6})t+318.02 \quad \text{[Expression 2]}$$

Figure 2A:
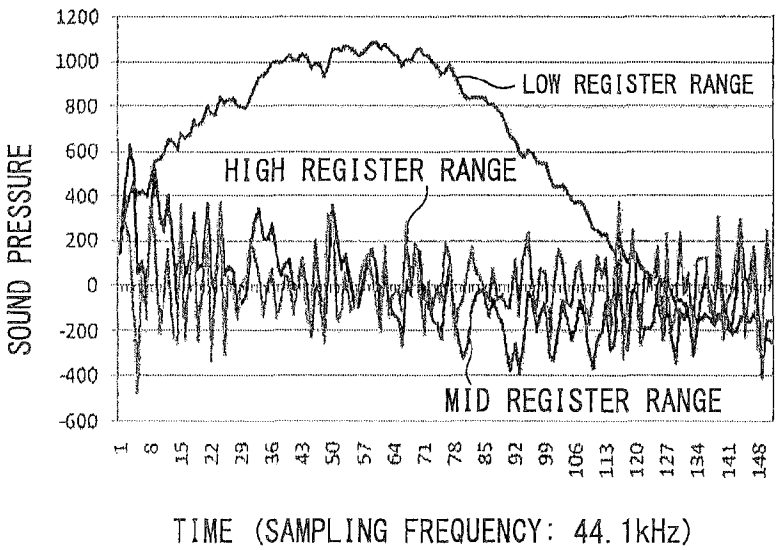
FIG. 2A and FIG. 2B each show a waveform of an audio signal used in the first embodiment of the present invention, wherein the audio signal is divided into a low register range, a mid register range, and a high register range.
Figure 2B:
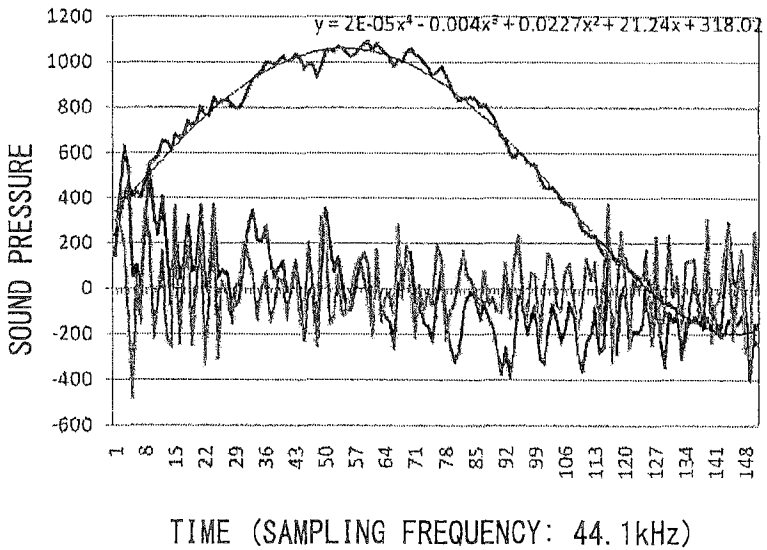

Expression 2 represents an approximated polynomial curve of a low register signal shown in FIG. 2B. As is known from Expression 2, the coefficient values of Expression 2 fall within a range of $10^2(2^8)$~$10^{13}(2^{40})$, which is an extremely wide range. Thus, Expression 2 is transformed to Expression 3 if a scale transformation is performed so that, for example, the coefficient of the fourth degree term and the coefficient of the third degree term become $(10^{-8}/4(2^{-32}))$-fold, the coefficient of the second degree term and the coefficient of the first degree term become $(2^{-16})$-fold, and the coefficient of the zero degree term become 1-fold.

$$y=(17532)_{10}t^4-(79.6)_{10}t^2+(672.9)_{10}t^2+(14.7)_{10}t+(318.02)_{10} \quad \text{[Expression 3]}$$

The following can be known from Expression 3:

Coefficient of fourth degree: $(17532)_{10}=(447C)_H\rightarrow$32-bits shifted

Coefficient of third degree: $(79.6)_{10}=(50)_H\rightarrow$32-bits shifted

Coefficient of second degree: $(672.9)_{10}=(2A1)_H\rightarrow$16-bits shifted

Coefficient of first degree: $(14.7)_{10}=(F)_H\rightarrow$16-bits shifted

Coefficient of zero degree: $(318.02)_{10}=(13E)_H\rightarrow$0-bits shifted (i.e., no shift)

All coefficient values can be expressed by 16-bits values. Incidentally, the inferior number "10" means the number is a decimal number, and the inferior letter "H" means the number is a hexadecimal number.

As a result, 16-bits is assigned to the coefficient of the fourth degree $(447C)_H$, 8-bits is assigned to the coefficient of the third degree $(50)_H$, 12-bits is assigned to the coefficient of the second degree $(2A1)_H$, 4-bits is assigned to the coefficient of the first degree $(F)_H$, and 12-bits is assigned to the coefficient of the zero degree $(13E)_H$. Such assignment is performed by the quantization bit assignment sections 31*a* to 31*m* shown in FIG. 1.

The signals to which the quantization bits are assigned by the quantization bit assignment sections 31*a* to 31*m* are sent to an encoding section 3, where encoding process is performed on the signals of all bands. Further, the encoded data is supplied to a bit-stream forming section 4, from which bit-stream data with a predetermined form is outputted. As described later, the bit-stream forming section 4 forms a bit-stream, to which side information encoded by a side information encoding section 5 is added according to necessity.

The side information encoded by the side information encoding section 5 includes various kinds of information associated with the encoding process, such as information about the frequency band of each of the divided bands divided by the filter bank 10, information about bit number assigned by the quantization bit assignment sections 31*a* to 31*m*, and the like. Here, the information provided from the filter bank 10 to the side information encoding section 5 is a number (a bank number shown in FIG. 3) indicating the band obtained by performing band-separating process, and the information provided from the function approximation section 20 to the side information encoding section 5 is information about functional form and function order. Further, shift amount when performing the aforesaid scale conversion of the coefficient values, bit-width of the coefficient, and coefficient data are provided from the quantization bit assignment sections 31*a* to 31*m*. An example of such bit-stream data, to which the side information is added, is shown in FIG. 3.

As shown in FIG. 3, the bit-stream data has a data structure configured by bank number (6-bits), functional form (1-bit), order (3-bits), shift amount (2-bits), bit numbers (2-bits) and coefficient values (0-bit to 16-bits), wherein the bank number shows a band number, the functional form shows whether the approximation is a sampling function approximation or a polynomial function approximation, the order shows the maximum number of times (m-1) by which the sampling function can be differentiated, the shift amount shows whether the shift amount is any one of 0-bit, 8-bits, 16-bits, and 32-bits, and the bit numbers shows whether the bit-width is any one of 0, 1, 2, and 3.

Further, an error detection code and an error correction code are generated in the bit-stream forming section 4 according to necessity, and the generated error detection code or error correction code is added to the bit-stream.

In such manner, the bit-stream data (see FIG. 3) outputted from the bit-stream forming section 4 is either transmitted to the receiving side through various transmission lines, for example, or stored in various storage media. Here, instead if the storage means of the encoding device, an external database may alternatively be used as the storage media for storing the bit-stream data.

[Description of Waveform Example of Encoded Signal]

FIGS. 4A to 4D are graphs showing an example of an audio signal processed by the encoding device shown in FIG. 1.

In the graph of each of FIGS. 4A to 4D, the horizontal axis represents time (second) and the vertical axis represents level.

Figure 4A:
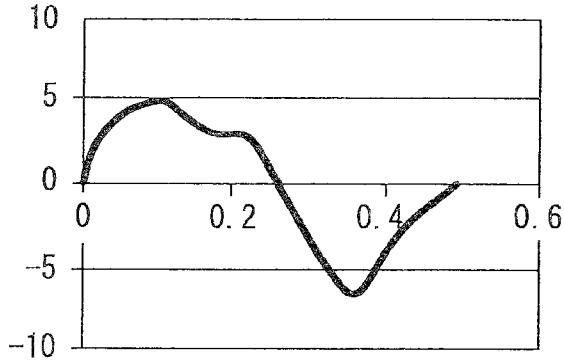
FIGS. 4A to 4D are each a graph showing an example of a signal waveform used for explaining the first embodiment of the present invention.

First, an analog audio signal (i.e., an original signal) shown in FIG. 4A is supplied to the analog-to-digital converter circuit 2. The analog-to-digital converter circuit 2 samples the supplied analog audio signal at a predetermined period, and thereby outputs a sampling signal shown in FIG. 4B. Incidentally, the sampling signal shown in FIG. 4B is plotted by a dotted line having the same waveform as that of the analog audio signal shown in FIG. 4A, which means that the sampling signal shown in FIG. 4B is a collection of sampling points sampled at a very short sampling period.

Figure 4B:
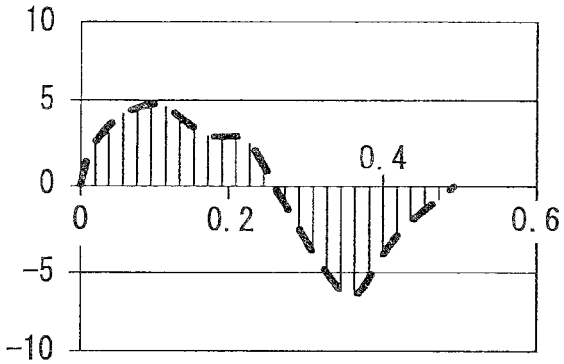
Figure 4C:
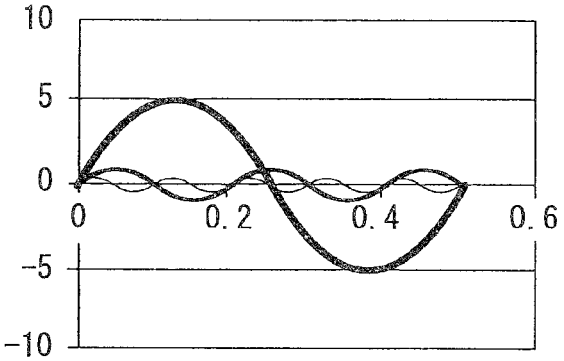

The sampling signal shown in FIG. 4B is band-separated by the bandpass filters 11*a* to 11*m* of the filter bank 10 so as to become frequency-separated signals shown in FIG. 4C. The frequency-separated signals includes signals corresponding to the frequency bands of bandpass filters 11*a* to 11*m*, and in the example of FIG. 4C, the signal is separated into three frequency components (i.e., m=3).

Figure 4D:
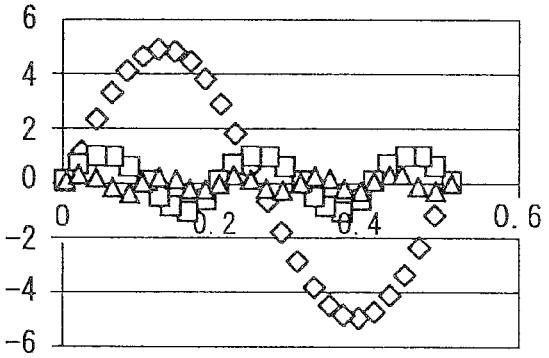

The three signals of the respective frequency components shown in FIG. 4C are down-sampled respectively by the down-sampling sections 12*a* to 12*m* of the filter bank 10 so as to become sampling values thinned out for each frequency component, as shown in FIG. 4D. Further, the sampling values down-sampled for each frequency component are function-approximated by the function approximation section 20.

[Description of Example of Band-Dividing Process]

Next, an example of performing band-dividing process in the bandpass filters 11*a* to 11*m* of the filter bank 10 shown in FIG. 1 will be described below.

In the present embodiment, the basic filter is configured with the sampling function ψ(k) as impulse response function, wherein the sampling function ψ(k) is expressed by a section polynomial. Further, the bandpass filters 11*a* to 11*m* whose the frequency band is shifted by a predetermined frequency are obtained by performing a known cosine modulation (which is to be described later) on the basic filter, for example. Here, the sampling function ψ(k) expressed by the section polynomial uses a fluency information theory obtained based on the studies by the inventor of the present invention.

Figure 5:
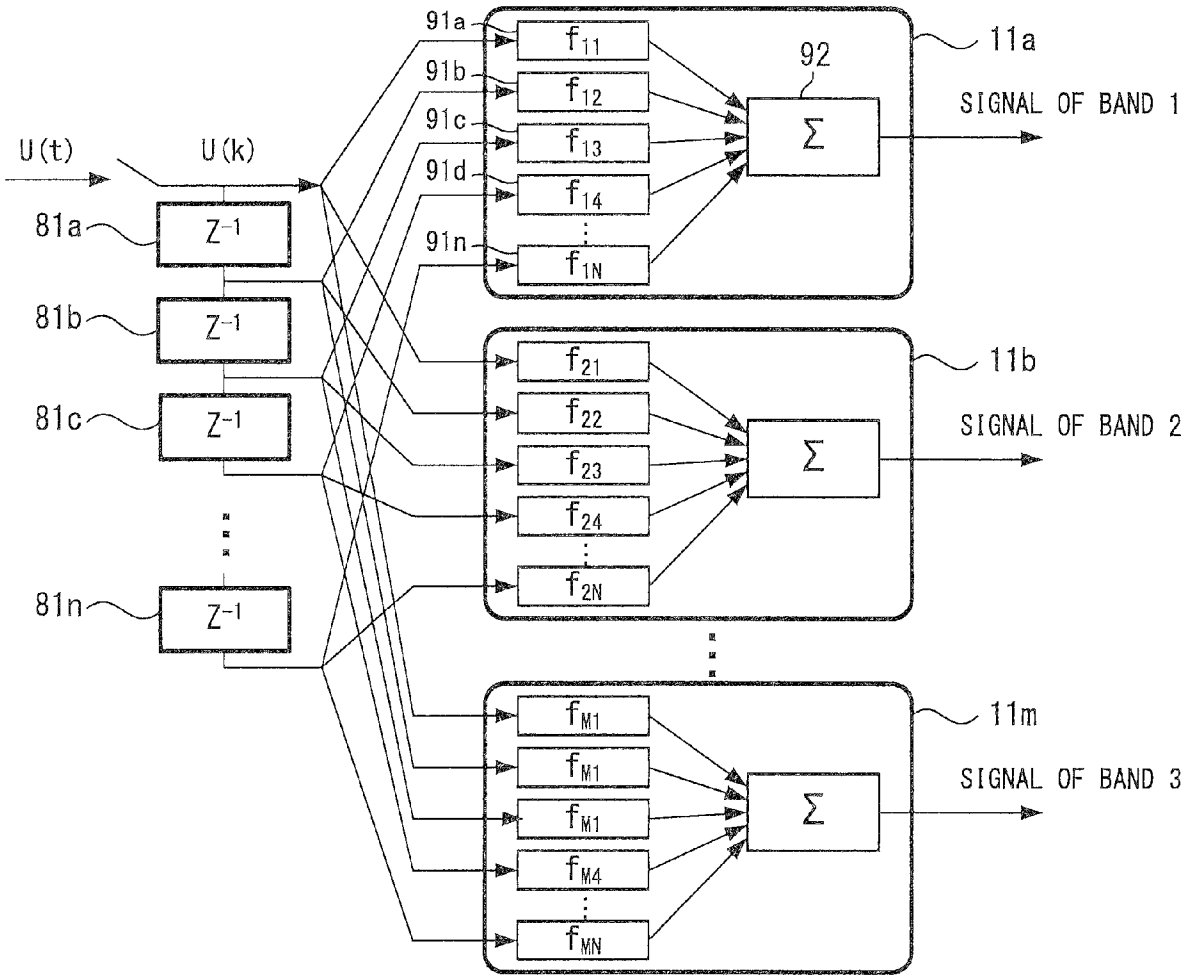
FIG. 5 is a block diagram showing the configuration of a bandpass filter provided in the first embodiment of the present invention.

FIG. 5 is a block diagram showing a configuration example of the bandpass filters 11*a* to 11*m* of the filter bank 10. First, the input audio signal is sequentially delayed by delay elements 81*a*, 81*b*, 81*c*, . . . , 81*n*. For example, in the bandpass filters 11*a* for extracting the signal of a band 1, the signals at respective delay positions are extracted respectively from the delay elements 81*a* to 81*n*, and the extracted signals are respectively supplied to different coefficient multipliers 91*a* to 91*n*. Further, the signals of the respective delay positions, which have been multiplied by a coefficient by the coefficient multipliers 91*a* to 91*n*, are summed by an adder 92, and the output of the adder 92 is outputted as the signal of the band 1.

Further, the bandpass filter 11*b*, which is adapted to extract the signal of a band 2, to the bandpass filter 11*m*, which is adapted to extract the signal of a band M (in the present example, the signal is divided into M bands), have the same configuration as that of the bandpass filter 11*a*, and the signals of band 2 to band M are obtained from the respective bandpass filters.

Here, in a concrete example of the cosine modulation, whole frequency is equally divided into M bands, and in the case where the i-th frequency band is extracted, the coefficient thereof is defined by the following Expression 4.

$$f_{ik} = 2\phi(k)\cos\left\{\frac{\pi}{M}\left(i+\frac{1}{2}\right)\left(k-\frac{2M-1}{1}\right)\right\} - (-1)^m\left(\frac{\pi}{4}\right) \quad \text{[Expression 4]}$$

Figure 6:
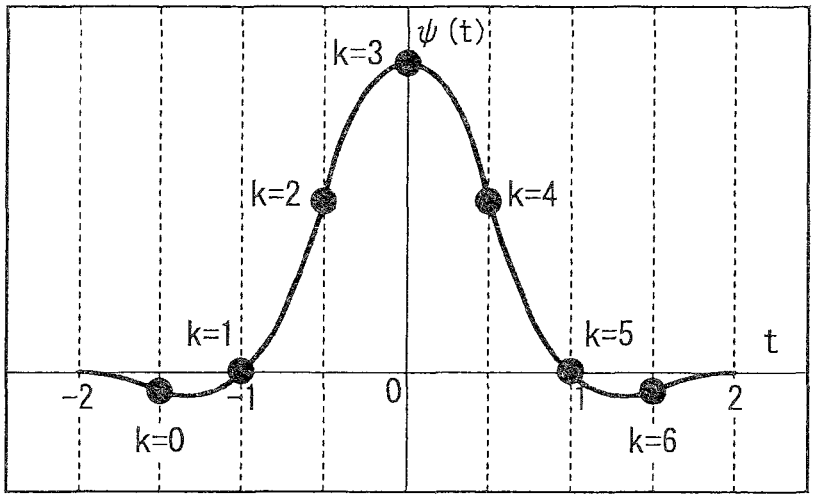
FIG. 6 is a characteristics chart showing an example of a sampling function used for explaining the first embodiment of the present invention.

Here, ψ(k) is the value of the k-th node of a fluency sampling function shown in FIG. 6. In FIG. 6, the horizontal axis represents time (t), and the values of each node and interval between the nodes are defined by the following expression.

$$\phi(t) = \begin{cases} -\frac{t^2}{4} - t - 1 & \left(-2 \le t \le -\frac{3}{2}\right) \\ \frac{3t^2}{4} + 2t + \frac{5}{4} & \left(-\frac{3}{2} \le t \le -1\right) \\ \frac{5t^2}{4} + 3t + \frac{7}{4} & \left(-1 \le t \le -\frac{1}{2}\right) \\ -\frac{7t^2}{4} + 1 & \left(-\frac{1}{2} \le t \le \frac{1}{2}\right) \\ \frac{5t^2}{4} - 3t + \frac{7}{4} & \left(\frac{1}{2} \le t \le 1\right) \\ \frac{3t^2}{4} - 2t + \frac{5}{4} & \left(1 \le t \le \frac{3}{2}\right) \\ -\frac{t^2}{4} + t - 1 & \left(\frac{3}{2} \le t \le 2\right) \end{cases} \quad \text{[Expression 5]}$$

[Description of Example of Function Approximation Process]

Next, an example of performing function approximation process with the function approximation section 20 shown in FIG. 1 will be described below with reference to FIGS. 7, 8A, 8B, 8C and 8D.

In the present embodiment, first, function approximation is performed on the signals having been down-sampled by the down-sampling sections 12*a* to 12*m* shown in FIG. 1, and the parameters of the function is used as compression signal values. However, the down-sampling performed herein is not an indispensable process for achieving the audio signal compression method of the present embodiment. Thus, the down-sampling and the function approximation are not inevitably linked to each other, and the function approximation may also be performed on signals having not been down-sampled. Obviously, since the amount of signal can be reduced to 1/M by down-sampling the original signal to 1/M, it is preferred to perform down-sampling process for purpose of reducing data volume.

Further, in the present embodiment, in the case where a band-divided signal array is function-approximated, an arbitrary section of the band-divided signals is approximated by an n-degree polynomial for each frequency band, for example. Here, the arbitrary section means, when referring to FIG. 4D, an interval between extreme values of the minimum frequency (i.e., an interval equivalent of half period between the maximum value and the minimum value), for example, and in the present embodiment, such section (i.e., the interval between extreme values) is approximated an n-degree polynomial different for each frequency band. Incidentally, if taking an inflection point in place of the maximum value or the minimum value, it is also possible to approximate an interval between the maximum value and the inflection point or an interval between the minimum value and the inflection point by a n-degree polynomial different for each frequency band.

Figure 7:
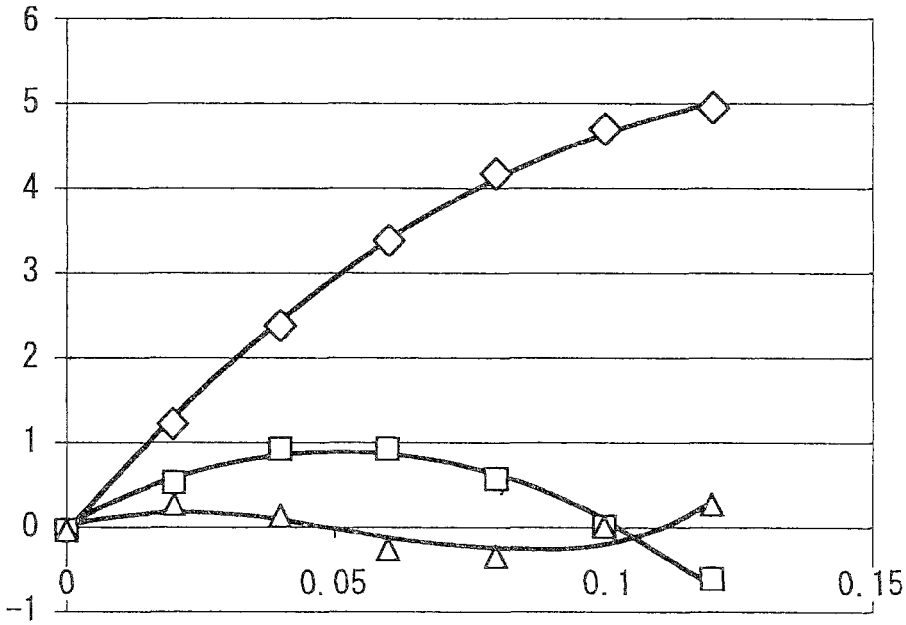
FIG. 7 is a characteristics chart showing an example of function approximation used for explaining the first embodiment of the present invention.

FIG. 7 is a graph showing an example in which approximation by n-degree polynomial is performed for each frequency band. To be specific, FIG. 7 shows an example in which approximation by 2-degree and 3-degree polynomials are performed on the signals of an initial portion (a portion between section 0 and section 0.12) of the down-sampled signals of three bands shown in FIG. 4D. In FIG. 7, the mark "◇" represents the lowest band (the band 1), the mark "□" represents the second-lowest band (the band 2), and the mark "Δ" represents the third-lowest band (the band 3). Expression 6 is obtained by formulating these graphs.

$$\text{Band 1: } y=-256.8x^2+73.33x-0.058 \quad \text{[Expression 6]}$$

$$\text{Band 2: } y=-338.0x^2+46.67x-0.033$$

$$\text{Band 3: } y=-35.84x^3-572x^2+19.57x-0.034$$

Incidentally, such polynomial approximation is expressed by a linear combination expression of fluency sampling functions $\psi^m(t)$ classified by number of times (m-1) at which the function is differentiable, the linear combination expression being defined as Expression 7.

$$y=a\phi^0(t)+b\phi^1(t)+c\phi^2(t)+d\phi^3(t)+ \quad \text{[Expression 7]}$$

The coefficients a, b, c, d, . . . of the polynomial of Expression 7 are coefficient values when the whole bit-stream is expressed as the polynomial, and are generated in the function approximation sections 21*a* to 21*m* shown in FIG. 1. Further, as described above, quantization bits are assigned to the data generated in the function approximation sections 21*a* to 21*m* by the quantization bit assignment sections 31*a* to 31*m*, and encoding process is performed by the encoding section 3. FIGS. 8A to 8D are each a graph showing function approximation between data performed by a single sampling function $\psi^m(t)$.

Figure 8A:
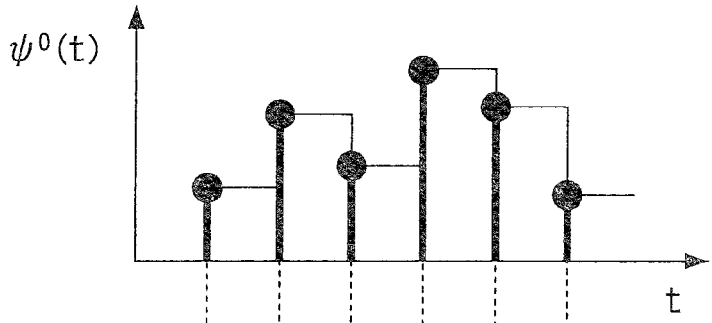
FIGS. 8A to 8D are each a graph showing an example of polynomial approximation used for explaining the first embodiment of the present invention.

To be specific, $\psi^0(t)$ (m=0) shown in FIG. 8A is a constant number, and is an indifferentiable function. In other words, if calculating the number of times (m-1) at which the function is differentiable, the result will be "−1", which is a meaningless number. Actually, the sampling function $\psi^0(t)$ is a rectangular pulse, and each sample value thereof remains unchanged until the next sample value.

Figure 8B:
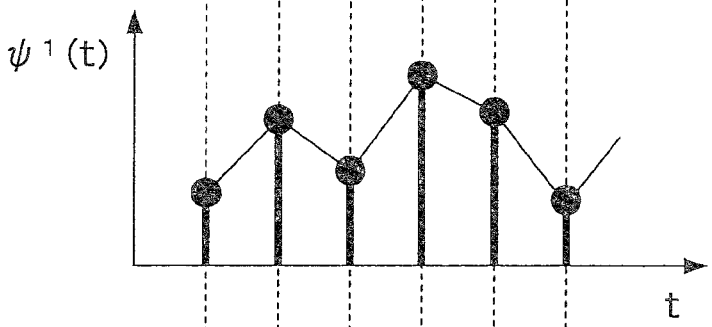
Figure 8C:
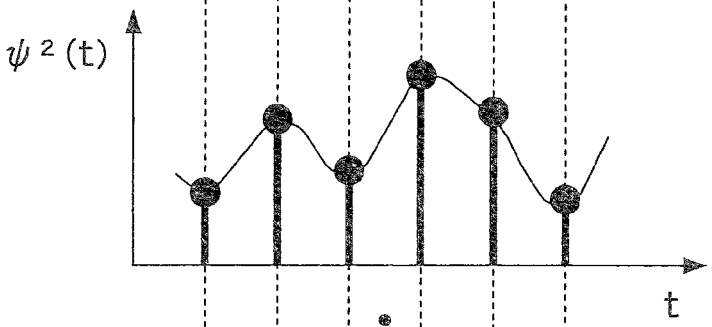

Further, $\psi^1(t)$ (m=1) shown in FIG. 8B is a function whose number of times (m-1) at which the function is differentiable is equals to 0, and as is known from FIG. 8B, the function is indifferentiable at the sample values. To be specific, $\psi^1(t)$ has a triangular waveform, and the function is indifferentiable at the points where two straight lines join together (i.e., at the sample points corresponding to the apexes of the triangular waves). As shown in FIG. 8B, the sampling function $\psi^1(t)$ is a function that straight-line approximates the relationship between the sample values.

Figure 8D:
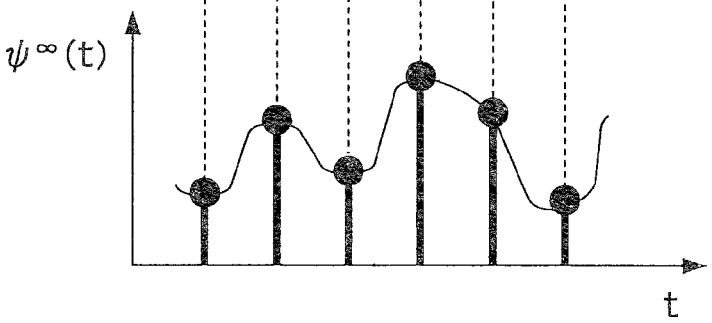

$\psi^2(t)$ (m=2) shown in FIG. 8B is an once-differentiable function wherein (m-1) is equals to 1, and approximates the relationship between the sample values to a quadratic curve. In similar manner, the shape of the curve for interpolating the values between the sample values changes every time when the order is increased, and the value of $\psi^\infty(t)$ is shown in FIG. 8D. Obviously, interpolated values will become more accurate when the order is increased.

In such a manner, the function approximation defined as Expression 7 is performed to a predetermined order, the coefficient values a, b, c, d, . . . (also referred to as "parameters of compressed signal") of the sampling functions $\psi^m(t)$ are extracted from the function approximation section 20 shown in FIG. 1, and the encoding process is performed by the encoding section as mentioned above.

Incidentally, other considerable parameters of the compressed signal include the "side information" provided to the side information encoding section 5 in FIG. 1. The data structure of the bit-stream data is shown in FIG. 3, however the bit-stream data does not include the time between extreme value points (for example, the relative time from the start of the audio signal of a song) and sampling point numbers. However, in the case where data having unequal intervals is compressed, the compression can be achieved by adding such side information to the bit-stream data shown in FIG. 3.

[Description of Another Example of Function Approximation Process]

Next, an example of performing function approximation different from the function approximation described with reference to FIGS. 6, 7, 8A, 8B, 8C and 8D will be described below with reference to FIGS. 9 to 13. In such a case, only process differs from the function approximation described with reference to FIGS. 6, 7, 8A, 8B, 8C and 8D is the process of the signals supplied to the function approximation sections 20, the signals being divided for each band; and process in other constituent sections is identical.

A sampling function $\psi_E(t)$, which is obtained by transforming a quadratic sampling function $\psi^2(t)$, is used in this example. Such a sampling function $\psi_E(t)$ is defined by Expression 8.

$$\phi_E(t)=f(t)+\alpha\cdot c_0(t) \qquad \text{[Expression 8]}$$

Figure 9:
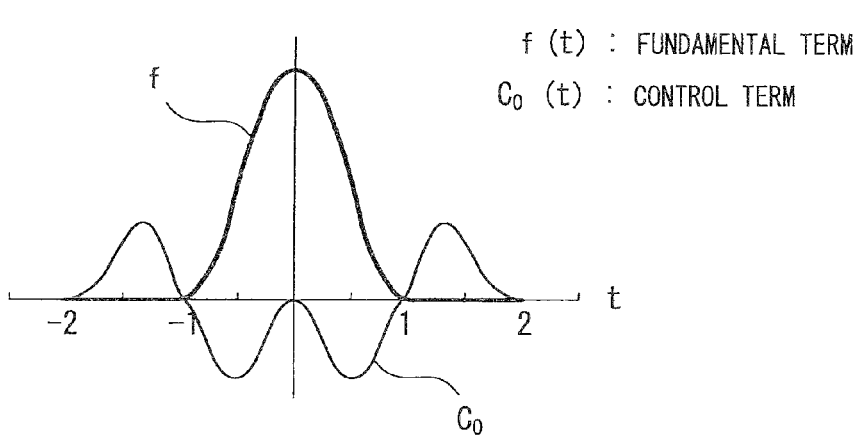
FIG. 9 is a graph showing time change of a fundamental term and a control term of the sampling function used in the first embodiment of the present invention.

In Expression 8, f(t) is a fundamental term, and $c_0(t)$ is a control term. FIG. 9 shows the relationship between the fundamental term f(t) and the control term $c_0(t)$. The sampling function defines the value of each of sample points, as a summed signal obtained by summing the waveform of the fundamental term f(t), which is a fundamental waveform, and the waveform of the control term $c_0(t)$ shown in FIG. 9. As shown in FIG. 9, the control term $c_0(t)$ is a function whose level varies up and down, and has a value of "0" at points of t=0, ±1, ±2.

Here, the fundamental term f(t) is a finite section polynomial function focused on differentiability, and, for example, is a function can be differentiated only once in the entire range. In other words, the fundamental term f(t) is a function whose function value is a finite value other than zero when a sample position t along the horizontal axis the is in an interval from −1 to +1 (i.e., in an interval [−1, 1]), and whose function value is constantly zero when the sample position t is in other intervals. Incidentally, a "finite" function is defined as a function whose function value is a finite value other than zero in the whole or a part of a local interval (excluding the sample position), and whose function value is zero in other intervals.

To be specific, the fundamental term f(t) is a function that is expressed by an n-degree polynomial function in each of two or more sub-intervals obtained by dividing the interval [−1, 1], and is continuous at the boundary of the sub-intervals (i.e., the value and slope at the boundary are each continuous). The fundamental term f(t) shows a convex-shaped waveform can be differentiated only (m-1) times (m is an integral number equal to or more than 2) in the entire range. Further, the function value becomes "1" only when t=1; the function value converges to "0" when t=±1; and the function value remains "0" until the sample position goes from "t=±1" to "t=±2". Incidentally, the fundamental term f(t) may either be a function of a finite impulse response waveform, or be a continuous n-th degree section polynomial function can be differentiated at least once at any position of the sample position interval. For example, as a concrete example, a fundamental sampling function f(t) expressed by a quadratic section polynomial function is defined as Expression 9.

$$f(t)=\begin{cases} 0 & (-\infty < t \le -1) \\ 2(t+1)^2 & \left(-1 \le t \le -\frac{1}{2}\right) \\ -2t^2+1 & \left(-\frac{1}{2} \le t \le \frac{1}{2}\right) \\ 2(-t+1)^2 & \left(\frac{1}{2} \le t \le 1\right) \\ 0 & (1 \le t < \infty) \end{cases} \qquad \text{[Expression 9]}$$

Next, the control term $c_0(t)$ will be described below. As shown in FIG. 9, the control term $c_0(t)$ is expressed as $c_0(t)=c_r(t)+c_r(-t)$. If being expressed by a quadratic section polynomial, $c_r(t)$ is defined as Expression 10.

$$c_r(t)=\begin{cases} 0 & (-\infty < t \le 0) \\ -t^2 & \left(0 \le t \le \frac{1}{2}\right) \\ 3(-t+1)^2-2(-t+1) & \left(\frac{1}{2} \le t \le 1\right) \\ -3(t-1)^2+2(t-1) & \left(1 \le t \le \frac{3}{2}\right) \\ (-t+2)^2 & \left(\frac{3}{2} \le t \le 2\right) \\ 0 & (2 \le t < \infty) \end{cases} \qquad \text{[Expression 10]}$$

Values between discrete data can be provisionally interpolated by performing superposition based each discrete data, using the control term $c_0(t)=c_r(t)+c_r(-t)$. Thus, it is possible to interpolate the value of any point between the discrete data by linearly summing the provisional interpolated value calculated based on the fundamental term f(t) and the provisional interpolated value calculated based on the control term $c_0(t)$.

Figure 10:
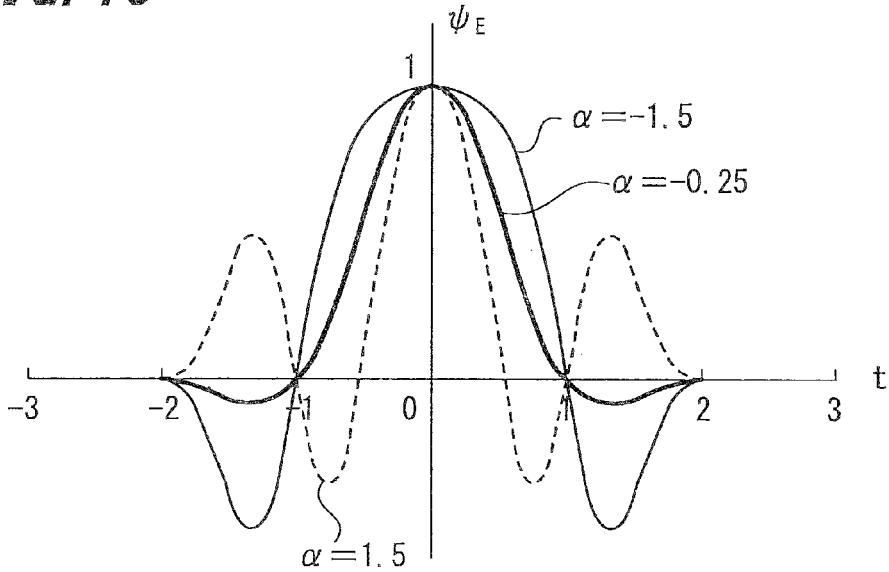
FIG. 10 is a graph showing time change of the sampling function used in the first embodiment of the present invention at the time when a coefficient of the control term is changed.

FIG. 10 is a graph showing the change of time characteristic of the sampling function $\psi_E(t)$ at the time when a coefficient α of the control term $c_0(t)$ of the sampling function $\psi_E(t)$ is changed. Thus, by suitably setting the coefficient α of the control term $c_0(t)$, the time characteristic of the finally obtained sampling function can be controlled.

FIG. 10 shows three examples of: coefficient α=−1.5, coefficient α=−0.25, and coefficient α=1.5. It is known from FIG. 10 that, when changing the coefficient α, the sampling function $\psi_E(t)$ largely changes.

For example, when changing the variable parameter $\alpha$ in the order of −1.5, −0.25, 1.5, the function value of the sampling function $\psi_E(t)$ will gradually increase in interval of "$-2 \le t \le -1$" and interval of "$1 \le t \le 2$", and the polarity of the waveform will be reversed. While the function value of the sampling function $\psi_E(t)$ will gradually decrease in interval of "$-1 \le t \le 0$" and interval of "$0 \le t \le 1$", and the polarity of the waveform will be reversed.

Figure 11:
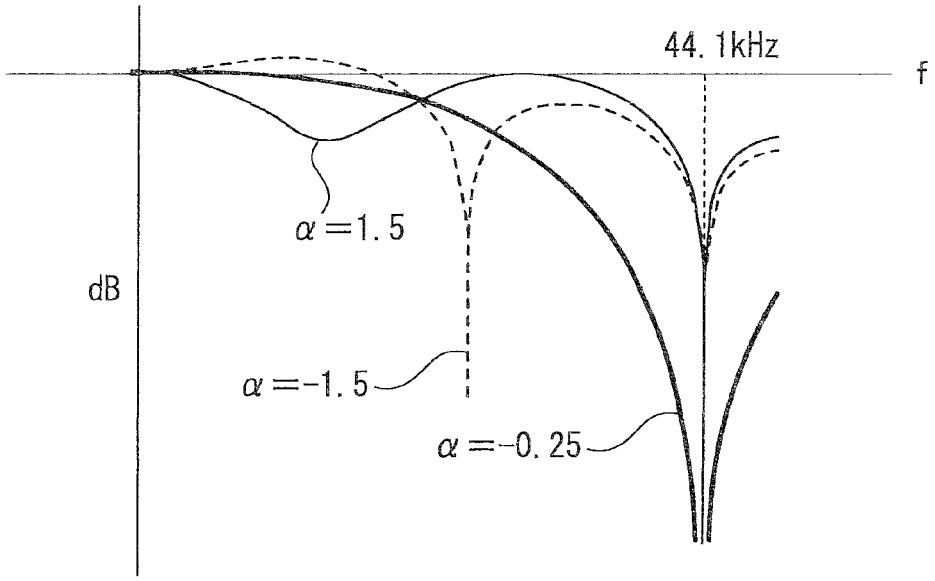
FIG. 11 is a graph for explaining an example of frequency characteristic of the sampling function used in the first embodiment of the present invention.

FIG. 11 shows frequency characteristic of the sampling function $\psi_E(t)$ when the coefficient a the control term $c_0(t)$ is set to different values. In FIG. 11, the horizontal axis represents frequency and the vertical axis represents gain [dB].

Thus, it is possible to change the characteristics of the sampling function by separately expressing the sampling function $\psi_E(t)$ into the fundamental term f(t) and the control term $c_0(t)$ and adjusting the coefficient $\alpha$ of the control term $c_0(t)$.

FIG. 11 shows the frequency characteristic of the sampling function $\psi_E(t)$ when playing music recorded in a CD, for example. As can be known from FIG. 11 that the frequency characteristic of the sampling function $\psi_E(t)$ is: when $\alpha=-0.25$, the characteristic (which represents a reference) is characterized that the gain gently decreases until frequency reaches 44.1 kHz, which is the sampling frequency of CD; and when $\alpha$ is changed to 1.5 or −1.5, the gain increases in high-frequency area, and a flat frequency characteristic is obtained in the whole frequency area. Further, in low-frequency area, the gain decreases when $\alpha=1.5$ but increases when $\alpha=-1.5$, compared with the case where $\alpha=-0.25$. This is a usable characteristic in the case where the low register range of music is wanted to be focused or emphasized. Thus, it is possible to obtain a characteristic so that the gain increases in high-frequency area, and a flat frequency characteristic is obtained in the whole frequency area by changing the value of $\alpha$, and it is also possible to adjust the increase or decrease of the gain (i.e., to make low register prominent, or to make high register prominent) in the low register range so as to obtain a characteristic suited to the taste of the user.

Figure 12A:
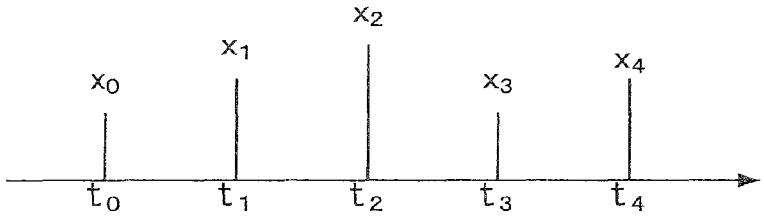
FIGS. 12A to 12F explain an example in which function approximation is performed by using the sampling function used in the first embodiment of the present invention.
Figure 12B:
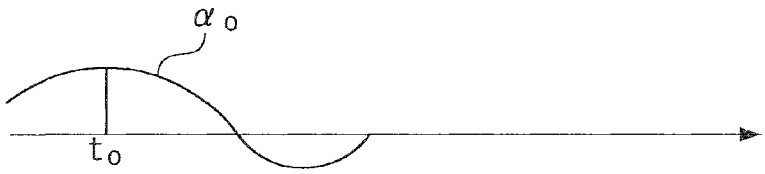
Figure 12C:
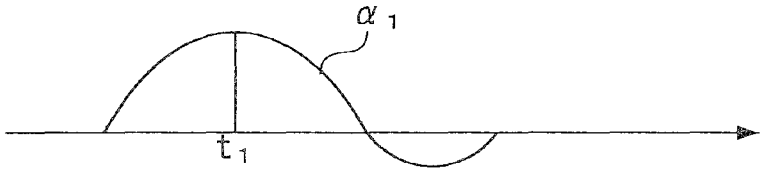
Figure 12D:
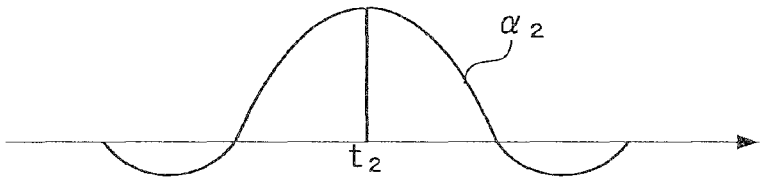
Figure 12E:
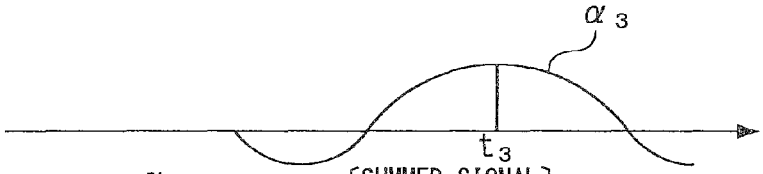
Figure 12F:
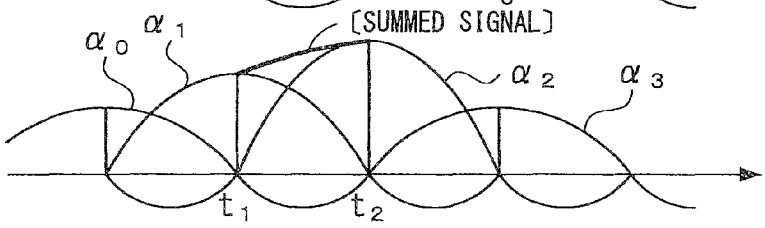

FIGS. 12A to 12B explain a method for interpolating values in an arbitrary signal interval, such as an interval between extreme values (i.e., an interval between sample values $x_1$ and $x_2$ (between time $t_1$ and $t_2$)) for example, using four sampling functions $\psi_E(t)$ (having four coefficient values of $\alpha_0$~$\alpha_3$) each having a coefficient value $\alpha$ of control term $c_0(t)$ different for each sample value. Thus, the waveforms in the interval between sample values $x_1$ and $x_2$ (between time $t_1$ and $t_2$) are function-approximated respectively by the four sampling functions, and the results are summed, and the summed value represents an approximated waveform of the original audio signal.

To be specific, as shown in FIG. 12A, sample values $x_0$, $x_1$, $x_2$, $x_3$, $x_4$, $x_5$ are respectively obtained at times $t_0$, $t_1$, $t_2$, $t_3$, $t_4$, $t_5$. Here, it is exhibited that the signal waveform between time $t_1$, and time $t_2$ is almost exactly approximated. In the example of FIGS, 12A to 12F, the coefficient of the control term $c_0(t)$ of the sampling function $\psi_E(t)$ at time $t_0$ is $\alpha_0$, the coefficient of the control term $c_0(t)$ at time $t_1$ is $\alpha_1$, the coefficient of the control term $c_0(t)$ at time $t_2$ is $\alpha_2$, and the coefficient of the control term $c_0(t)$ at time $t_3$ is $\alpha_3$.

At this time, the signal waveform in the interval between time $t_1$ and time $t_2$ is obtained by summing the waveforms of the four signals in the interval between time $t_1$ and time $t_2$. The signal waveform in the interval between other two sample points is also obtained by summing the waveforms of the four corresponding sampling functions $\psi_E(t)$.

The summed signal can be defined as Expression 11.

$$y(t)=\psi_E(t-t_0)x_0+\psi_E(t-t_1)x_1+\psi_E(t-t_2)x_2+\phi_E(t-t_3) \quad \text{[Expression 11]}$$

Thus, the signal y(t) between sample values (i.e., in the interval) can be exactly exhibited by summing the sampling functions $\psi_E(t)$, and it is possible to obtained a well compressed signal.

Here, the coefficient $\alpha$ of the control term $c_0(t)$ of each of the sampling functions $\psi_E(t)$ needs to be selected to a suitable value; however, since it is difficult to calculate a correct coefficient $\alpha$ at the head portion of the audio signal inputted in real time, a fixed value $\alpha_0$ can be considered as the coefficient $\alpha$ at the head portion.

Figure 13:
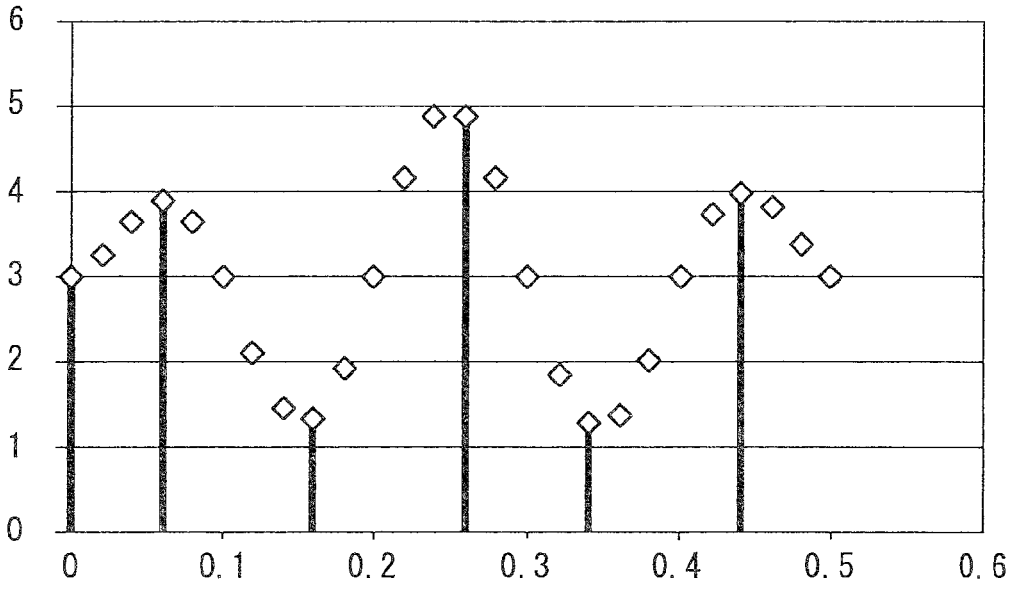
FIG. 13 is a graph showing a signal array in the case where the function approximation is performed by the sampling function used in the first embodiment of the present invention.

FIG. 13 is a graph showing an inputted typical digital signal array. As shown in FIG. 13, in the aforesaid signal array, the extreme values, which are indicated by heavy lines, exist at t=[0, 0.06, 0.16, 0.26, 0.34, 0.44].

Initialization is performed so that at start time (i.e., t=0) of the signal array, the coefficient $\alpha$ is the fixed value $\alpha_0$ (for example, $\alpha_0=-0.25$, which corresponds to a sampling function most suitable for playing signal having an equal interval).

Here, in the case of $\psi_E(t-\tau)$ obtained by shifting the sampling function $\psi_E(t)$ defined by Expression 8 by time $\tau$, the value of the sampling function is equal to the value of $\psi_E(0)$ when $t=\tau$, and it is possible to perform a convolution operation with the sample values. The convolution operation will be described below. The case considered here is one in which input signal values $y_a(t)$ in the time interval $[\tau_k, \tau_{k+1}]$ are interpolated using the sampling function $\psi_E(t)$. At this time, based on the fluency theory proposed by the inventor of the present invention, the input signal is approximated according to Expression 12 by using four sample values, which are two sample values $y_a(\tau_k)$, $y_a(\tau_{k+1})$ at ends of the interval, and two sample values $y_a(\tau_{k-1})$, $y_a(\tau_{k+2})$ before and after the interval.

$$y_a(t)=\phi_E(t-\tau_{k-1})y_a(\tau_{k-1})+\phi_E(t-\tau_k)y_a(\tau_k)+\phi_E(t-\tau_{k+1})y_a(\tau_{k+1})+\phi_E(t-\tau_{k+2})y_a(\tau_{k+2}) \quad \text{[Expression 12]}$$

In Expression 12, since the influence of the fourth term $\psi_E(t-\tau_{k+2})y_a(\tau_{k+2})$ on the signal $y_a(t)$ in the interval $[\tau_k,\tau_{k+1}]$ is small, the fourth term $\psi_E(t-\tau_{k+2})y_a(\tau_{k+2})$ is omitted, so that an approximate expression possible to be successively calculated can be obtained as Expression 13.

$$y_a(t)\approx\phi_E(t-\tau_{k-1})y_a(\tau_{k-1})+\phi_E(t-\tau_k)y_a(\tau_k)+\phi_E(t-\tau_{k+1})y_a(\tau_{k+1}) \quad \text{[Expression 13]}$$

In Expression 13, unknown sampling function (wherein $\alpha$ is unknown) is in $\psi_E(t-\tau_{k+1})$ of the third term. In other words, this thinking is to perform approximation with the value of Expression 13 to identify the input signal in the interval $[\tau_k, \tau_{k+1}]$.

If $\psi_E(t-\tau_{k-1})$ and $\psi_E(t-\tau_k)$ are previously obtained, Expression 14 can be obtained based on Expression 13. To be specific, if actual sample value at time t is $y_a(t)$, Expression 13 can be transformed into Expression 14 using an actual sample value $y_a(\tau_{k-1})$ when "$t=\tau_{k-1}$" and a sample value $y_a(\tau_{k-1})$ when "$t=\tau_{k-1}$ and a sample value $y_a(\tau_k)$ when "$t=\tau_k$". $\Delta y(t)$ in Expression 14 is $\psi_E(t-\tau_{k+1})y_a(\tau_{k+1})$, which is what to be obtained here.

$$\Delta y(t)=y_a(t)-(\phi_E(t-\tau_{k-1})y_a(\tau_{k-1})+\phi_E(t-\tau_k)y_a(\tau_k))\approx\phi_E(t-\tau_{k+1})y_a(\tau_{k+1}) \quad \text{[Expression 14]}$$

Here, sampling function $\psi_E(t-\tau_{k+1})=f(t-\tau_{k+1})+\alpha_{k+1}c(t-\tau_{k+1})$ is obtained (wherein $\alpha_{k+1}$ is an unknown) by using Expression 8, so that Expression 15 can be obtained.

$$\Delta y(t)\approx\phi_E(t-\tau_{k+1})y_a(\tau_{k+1})=\{f(t-\tau_{k+1})+\alpha_{k+1}c(t-\tau_{k+1})\}y_a(\tau_{k+1}) \quad \text{[Expression 15]}$$

In Expression 15, since $f(t-\tau_{k+1})$ is the fundamental term component and is a known function, if the control term component, which is a value subtracted from $\Delta y(t)$, is expressed as $\Delta x(t)$, than $\Delta x(t)$ can be defined by Expression 16.

$$\Delta x(t)=\Delta y(t)-f(t-\tau_{k+1})y_a(\tau_{k+1})\approx\alpha_{k+1}c(t-\tau_{k+1})y_a(\tau_{k+1}) \quad \text{[Expression 16]}$$

If approximation error of Expression 16 is expressed as $\epsilon(t)$, the following Expression 17 can be obtained.

$$\epsilon(t)=\Delta x(t)-\alpha_{k+1}c(t-\tau_{k+1})y_a(\tau_{k+1}) \quad \text{[Expression 17]}$$

From Expression 17, approximation error $\epsilon(t)$ in the interval $[\tau_k, \tau_{k+1}]$ is obtained with respect to all input points, the approximation error $\epsilon(t)$ is created for n points (preferably for all points) in the interval $[\tau_k, \tau_{k+1}]$, and E, which represents the sum of n-pieces of square of $\epsilon(t_i)$, is obtained by Expression 18.

$$E=\sum_{i=1}^{n}\varepsilon^2(t_i) \quad \text{[Expression 18]}$$

The $\alpha_{k+1}$ which makes E minimum is the $\alpha_{k+1}$ to a curve of the minimum square error approximation. In other words, the $\alpha_{k+1}$ that makes E minimum is obtained when Expression 19 is true, and can be obtained by Expression 20.

$$\frac{\partial E}{\partial \alpha_{k+1}}=0 \quad \text{[Expression 19]}$$

$$\alpha_{k+1}=\frac{\sum_{i=1}^{n}\{c(t_i-\tau_{k+1})y_a(\tau_{k+1})\Delta x(t_i)\}}{\sum_{i=1}^{n}\{c(t_i-\tau_{k+1})y_a(\tau_{k+1})\}^2} \quad \text{[Expression 20]}$$

herein:

$$\Delta x(t_i)=\Delta y(t_i)-f(t_i-\tau_{k+1})y_a(\tau_{k+1})$$

$$\Delta y(t_i)=y_a(t_i)-(\phi_E(t_i-\tau_{k-1})y_a(\tau_{k-1})+\phi_E(t_i-\tau_k)y_a(\tau_k))$$

If $\alpha_{k+1}$, which is the coefficient of the control term, has been determined based on the above Expression 20, the signal in the interval $[\tau_k, \tau_{k+1}]$ can be played with minimum approximation error when $t=\tau_{k+1}$ by using Expression 21.

$$y(t)=\phi_E(t-\tau_{k-1})y_a(\tau_{k-1})+\phi_E(t-\tau_k)y_a(\tau_k)+\phi_E(t-\tau_{k+1})y_a(\tau_{k+1}) \quad \text{[Expression 21]}$$

Next, the sample value $y_a(t)$ in the interval $[\tau_k, \tau_{k+1}]$ is calculated when the interval $[\tau_k, \tau_{k+1}]$ is [0, 0.06] (an interval between the sample point at t=0 and the sample point at t=0.06 shown in FIG. 13, i.e., when $\tau_k=0$, and $\tau_{k+1}=0.06$).

Incidentally, in the case where calculation is performed in the interval [0, 0.06], since $\tau_{k-1}$ does not exist, it is supposed that $y_a(\tau_{k-1})=0$. Here, in Expression 20, calculation is performed at three points i=1, 2, 3.

If input signal $y_a(0)$ at the time when t=0 is substituted in $\Delta y(t_i)$ of Expression 20, $\Delta y(t_i)$ becomes a value obtained by subtracting "$(f(t_i)+\alpha_0*c_0(t_i))*y_a(0)$" from input signal $y_a(t_i)$.

On the other hand, since $\tau_{k+1}=0.06$, $\Delta x(t)$ (which is the control term) is calculated below based on Expression 16:

$$\Delta x(t)=\Delta y(t)-f(t-0.06)*y_a(0.06)$$

$\Delta y(t)$ is calculated below based on Expression 15:

$$\Delta y(t)=\{f(t-0.06)+\alpha_1 c_0(t-0.06)\}*y_a(0.06)$$

The below expression can be obtained by substituting $\Delta y(t)$ in the expression of $\Delta x(t)$:

$$\Delta x(t)=\Delta y(t)-f(t-0.06)*y_a(0.06)=\alpha_1*c_0(t-0.06)*y_a(0.06)$$

An equation of $\alpha_1$ by which the sum of squares of the error function $\epsilon(t)$ becomes the minimum can be created by applying the above relationship to "$t=t_i(i=1, 2, 3)$". Here, the only unknown is $\alpha_1$, therefore $\alpha_1$ can be obtained from Expression 20.

Similarly, when data at "t=0.16" is inputted, the next coefficient $\alpha_2$ can be determined based on the data in the interval [0.06, 0.06], so that the coefficient $\alpha_i$ can be sequentially obtained. If the coefficient $\alpha_i$ is obtained, the data in the corresponding time interval become function-approximated.

Generally, when a sampling function $\Psi(t)$ having an unknown parameter with variable characteristics ($\Psi(t)=\psi_E(t)$ in the present invention) is provided, it is possible to provide Expression 22 (as an approximate expression) with respect to the input signal $y_a(t)$ (in which time t is in the interval $[\tau_k, \tau_{k+1}]$) to identify the unknown parameter of $\Psi(t-\tau_{k+1})$ so that Expression 22 is approximated with the minimum square error.

$$y_a(t)\approx\Psi(t-\tau_{k-1})y_a(\tau_{k-1})+\Psi(t-\tau_k)y_a(\tau_k)+\Psi(t-\tau_{k+1})y_a(\tau_{k+1}) \quad \text{[Expression 22]}$$

In the case where the sampling function is expressed as "$\Psi(t)=f(t)+\alpha c(t)$", such as the case of the present invention, the unknown parameter $\alpha$ is identified based on Expression 23. Expression 23 is an equivalence of Expression 20.

$$\alpha_{k+1}=\frac{\sum_{i=1}^{n}\{c(t_i-\tau_{k+1})y_a(\tau_{k+1})\Delta x(t_i)\}}{\sum_{i=1}^{n}\{c(t_i-\tau_{k+1})y_a(\tau_{k+1})\}^2} \quad \text{[Expression 23]}$$

herein:

$$\Delta x(t_i)=\Delta y(t_i)-f(t_i-\tau_{k+1})y_a(\tau_{k+1})$$

$$\Delta y(t_i)=y_a(t_i)-(\Psi(t_i-\tau_{k-1})y_a(\tau_{k-1})+\Psi(t_i-\tau_k)y_a(\tau_k))$$

$$\Psi(t-\tau_k)=f(t-\tau_k)+\alpha_k c(t-\tau_k)$$

Thus, as compressed data, it is possible to treat $[y_a(k), \alpha_k, \tau_k]$ as data of one interval, so that number of data can be reduce to far less than the number of the original sample data.

Further, when playing the signal encoded in such a manner, function interpolation when time t is in the interval $[\tau_k, \tau_{k+1}]$ can be performed based on Expression 24 by performing function arithmetic from the compressed data of $[y_a(k), \alpha_k, \tau_k]$.

$$y(t)=\phi_E(t-\tau_{k-1})y_a(\tau_{k-1})+\phi_E(t-\tau_k)y_a(\tau_k)+\phi_E(t-\tau_{k+1})y_a(\tau_{k+1})\ \phi_E(t-\tau_k)=f(t-\tau_k)+\alpha_k c(t-\tau_k) \quad \text{[Expression 24]}$$

In other words, the signal y(t) is approximated with respect to the original signal $y_a(t)$ with the minimum square error, and can be outputted as an accurately reconstructed and interpolated reproduced signal.

[Description of Block Diagram for Performing Decoding Process]

Figure 14:
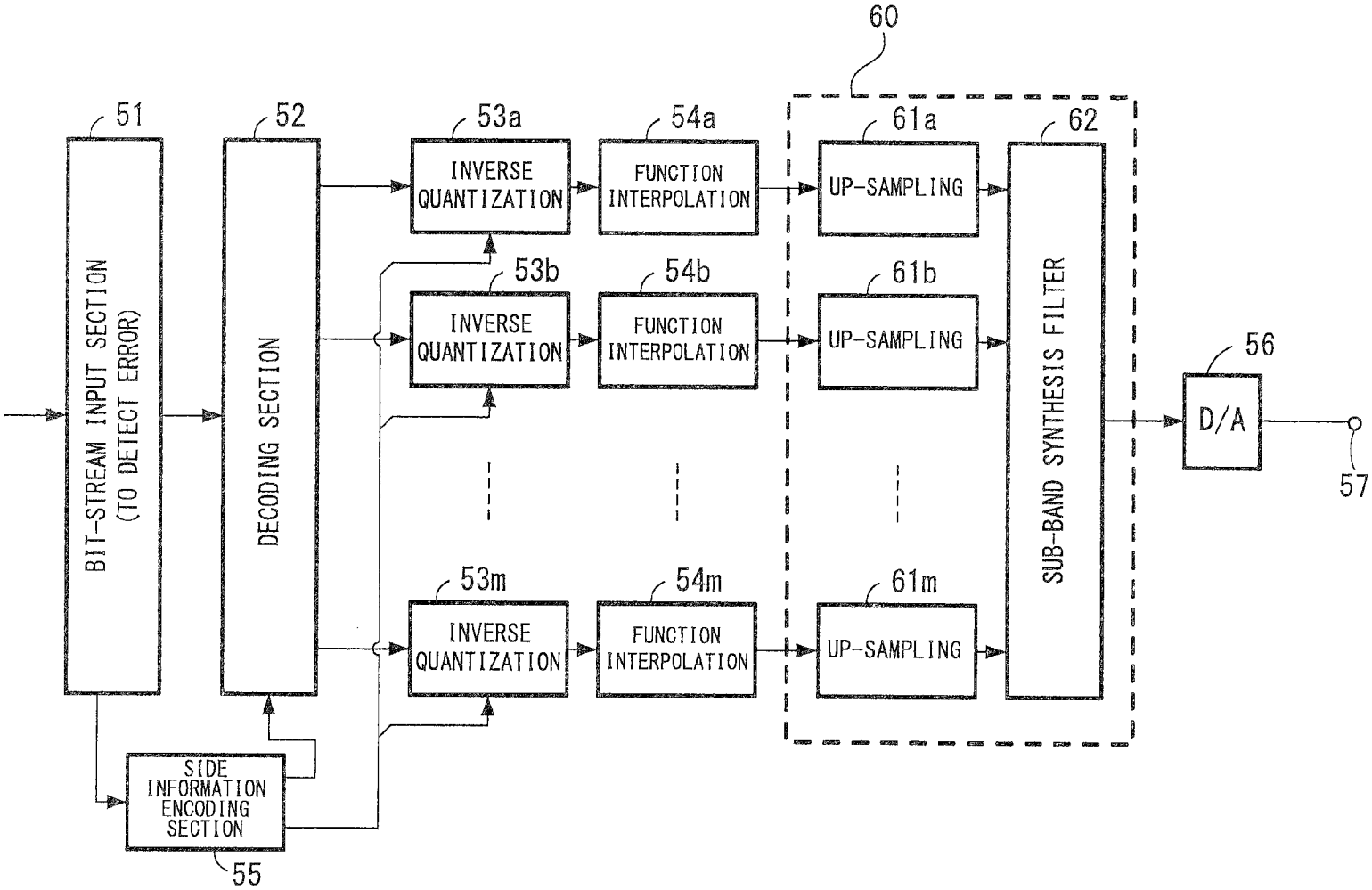
FIG. 14 is a block diagram showing an example of the block configuration for decoding the audio signal encoded using the first embodiment of the present invention.

FIG. 14 is a block diagram showing the configuration of a decoding device for the signal processed and encoded by the encoding device shown in FIG. 1.

As shown in FIG. 14, the bit-stream encoded by the bit-stream forming section 4 shown in FIG. 1 is supplied to a bit-stream input section 51 where an error detection process or error correction process is performed using the error detection code or error correction code added to the bit-stream.

Further, from the inputted bit-stream, the encoded data of the compressed parameters of the function (i.e., the coefficient values a, b, c, d, . . . , of the sampling functions $\psi^m(t)$) is supplied to a decoding section 52 where the parameter is decoded for each band. When decoding the parameter, side information from a side information decoding section 55 is referenced. The side information is the information provided from the filter bank to the side information encoding section 5 as described above. To be specific, the side information includes information about the number indicating the band obtained by performing band-separating process (i.e., the bank number shown in FIG. 3), information about the form and order of the function from the function approximation section 20, and the like. The side information is separated by the bit-stream input section 51, and supplied to the side information decoding section 55 so as to be decoded.

The parameter of each of the bands decoded by the decoding section 52 is supplied to the inverse quantization sections 53*a* to 52*m* where inverse quantization is performed. Further, each parameter having been subjected to the inverse quantization by the inverse quantization sections 53*a* to 53*m* is supplied to function interpolation sections 54*a* to 54*m*, by which the values of the sample points of each band are reconstructed. Here, the process performed by the function interpolation sections 54*a* to 54*m* is a process inverse to the approximation process performed by the function approximation sections 21*a* to 21*m* on the side of the encoding device shown in FIG. 1.

Further, the output of each of the function interpolation section 54*a* to 54*m* is supplied to up-sampling sections 61*a* to 61*m* of a filter bank 60, where a process inverse to the process performed by the down-sampling sections 12*a* to 12*m* on the side of the encoding device shown in FIG. 1 is preformed. The up-sampled output of each band is supplied to a sub-band synthesis filter 62 to be synthesized to a digital audio signal of one system. Further, the obtained digital audio signal is supplied to a digital-to-analog converter 56, and the analog audio signal converted by the digital-to-analog converter 56 is outputted to an output terminal 57.

Thus, by performing the decoding process, which is a process inverse to the encoding process, the original audio signal can be well reconstructed.

[Description of Second Embodiment]

A second embodiment of the present invention will be described below with reference to FIG. 15. The second embodiment shown in FIG. 15 and the first embodiment shown in FIG. 1 are identical to each other except for the filter bank 10. Since the other components (i.e., the function approximation section 20, the quantization bit assignment sections 31*a* to 31*m*, the encoding section 3, the bit-stream forming section 4, and the side information encoding section 5) in the second embodiment are identical to those of the first embodiment, these components are denoted by the same reference numerals as of the first embodiment and the explanation thereof will be omitted.

First, an example of entire configuration of an encoding device of the second embodiment of the present invention will be described below with reference to FIG. 15. As shown in FIG. 15, an analog audio signal is supplied from an audio signal source 1 to an analog-to-digital converter 2 in the same manner as the first embodiment. The digital audio signal outputted from the digital-to-analog converter 2 is supplied to a filter bank 10. The filter bank 10 is adapted to divide the digital audio signal into signal components of a plurality of bands in different manner from the first embodiment shown in FIG. 1.

Figure 15:
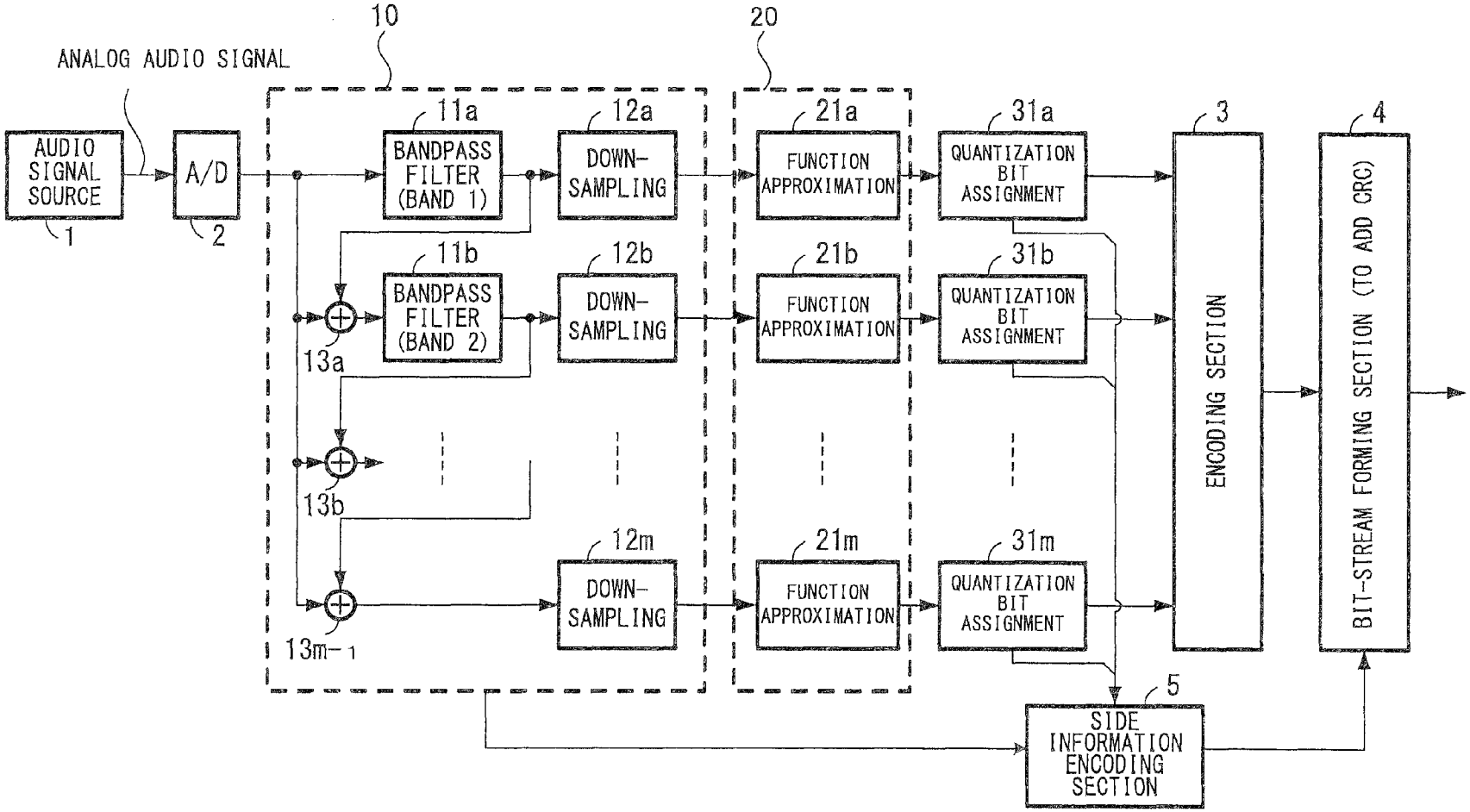
FIG. 15 is a block diagram showing the configuration of an encoding device used in a second embodiment of the present invention.

Similar to FIG. 1, the filter bank 10 shown in FIG. 15 (the second embodiment) also has a plurality of bandpass filters 11*a* to 11*m* (m is an arbitrary integral number, and herein m is a number corresponding to division number), the number of bandpass filters corresponding to the division number by which the frequency band is divided. Further, each of the bandpass filters 11*a* to 11*m* constitutes a basic filter to perform band-dividing with a sampling function $\psi(k)$, for example, as impulse response function, wherein the sampling function $\psi(k)$ is expressed by a section polynomial.

First, in the second embodiment, the signal of a first frequency band is separated by the bandpass filter 11*a*. Further, the signal separated by the bandpass filter 11*a* and the original audio signal supplied from the analog-to-digital converter 2 are supplied to a subtracter 13*a*, where the signal separated by the bandpass filter 11*a* is subtracted from the original audio signal. Further, the signal from the subtracter 13*a* is sent to the bandpass filter 11*b*, where the signal of a second frequency band is separated.

In the same manner, the output of each of the bandpass filters 11*b*, 11*c*, . . . is supplied to a corresponding one of a plurality of subtracters 13*b*, 13*c*, . . . arranged before the bandpass filter of the next band so as to be subtracted from the digital audio signal supplied from the analog-to-digital converter 2, and the subtracted signal is sent to the bandpass filter. Note that, the aforesaid connection of the subtracters is just one example, and the present invention includes other configurations for performing the subtraction process such as the configurations shown in FIGS. 16 to 19, which are to be described later.

The signals band-divided by the bandpass filters 11*a* to 11*m* are respectively supplied to down-sampling sections 12*a* to 12*m*, which are provided individually for the signal of each band, where a down-sampling process is performed in which sampling number is thinned out to, for example, a fraction.

The signal down-sampled by each of the down-sampling sections 12*a* to 12*m* is supplied to a function approximation section 20 where function approximation process is performed for each divided band by function approximation sections 21*a* to 21*m* as is described with reference to FIG. 1. The following operations are identical to those having been described with reference to FIG. 1, and therefore will not be repeated here.

Next, a first modification of a band separation filter used in the second embodiment of the present invention will be described below with reference to FIG. 16.

Figure 16:
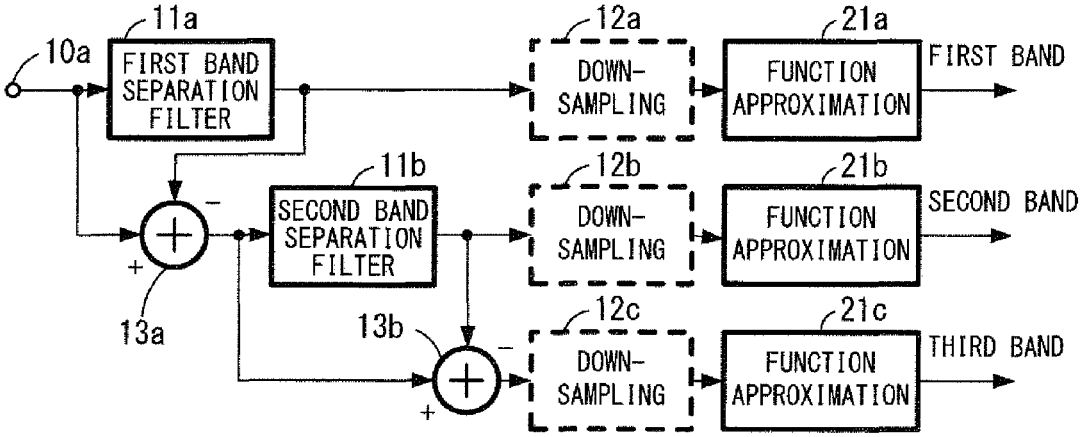
FIG. 16 is a diagram showing a first modification of a band separation filter used in the second embodiment of the present invention.

As shown in FIG. 16, the digital audio signal outputted by the analog-to-digital converter 2 shown in FIG. 1 or a digital audio signal inputted from the outside is inputted to a terminal 10*a*.

The digital audio signal inputted to the terminal 10*a* is supplied to a first band separation filter 11*a*, where the signal component of a first band is extracted. The signal of the first band is down-sampled by a down-sampling section 12*a*. Further, the down-sampled signal of the first band is supplied to a function approximation section 21*a* of the function approximation section 20 to be function-approximated.

Further, the digital audio signal of the first band outputted by the first band separation filter 11*a* is supplied to a subtracter 13*a*. The subtracter 13*a* subtracts the digital audio signal outputted by the first band separation filter 11*a* from the digital audio signal inputted to the terminal 10*a*, and the result is supplied to a second band separation filter 11*b*. Further, the signal component of the second band extracted in the second band separation filter 11*b* is down-sampled by a down-sampling section 12*b* and then supplied to a function approximation section 21*b* to be function-approximated.

Similarly, the difference signal from the subtracter and the digital audio signal of the second band outputted from the second band separation filter 11*b* are supplied to a subtracter 13*b*, and a signal obtained by subtracting the signal of the second band outputted from the second band separation filter 11*b* from the output of the subtracter 13*a* is outputted from the subtracter 13*b*. Further, the output from the subtracter 13*b* is down-sampled by a down-sampling section 12*c* and then function-approximated as the signal of a third band by a function approximation section 21*c*.

When being band-divided and function-approximated with a circuit configuration shown in FIG. 16, as the band-divided signal, no overlapped part of signal components will be caused in the end portions of each frequency band, and therefore better band-dividing can be performed. To be specific, when extracting the signal component of the second band with the amount of data 11*b*, since the signal component of the first band has been moved by the subtracter 13*a* arranged before the second band separation filter 11*b*, the signal component of the first band will not be added, and therefore the overlapping of the signal component of the first band can be effectively removed. The overlapping of signal component of the signal components of the second band and third band can also be removed in the same manner.

Next, a second modification of the band separation filter used in the second embodiment of the present invention will be described below with reference to FIG. 17.

Figure 17:
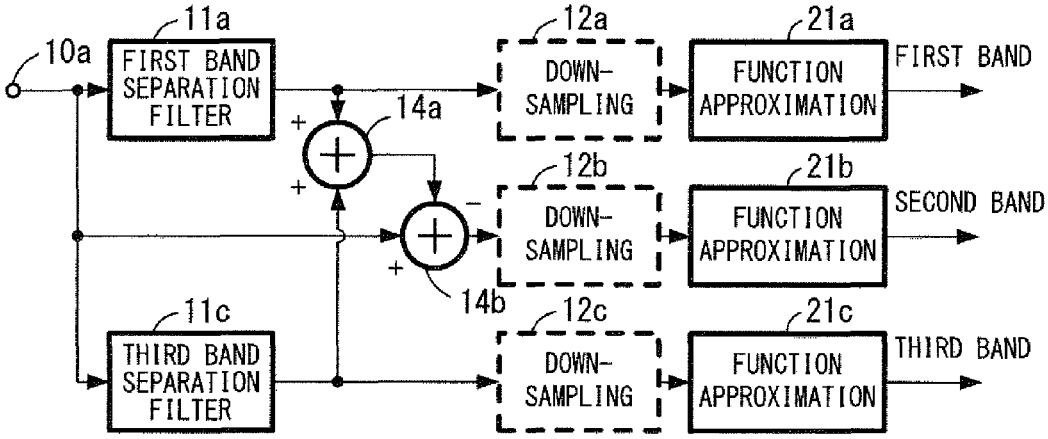
FIG. 17 is a diagram showing a second modification of the band separation filter used in the second embodiment of the present invention.

As shown in FIG. 17, the digital audio signal obtained in an input terminal 10*a* is supplied to a first band separation filter 11*a*, where the signal component of a first band (the low register signal component) is extracted. The signal of the first band is down-sampled by a down-sampling section 12*a*, and then the down-sampled signal of the first band is function-approximated by a function approximation section 21*a*.

Further, the digital audio signal obtained in the terminal 10*a* is supplied to a third band separation filter 11*c*, where the signal component of a third band (the high register signal component) is extracted. The signal of the third band is down-sampled by a down-sampling section 12*c*, and then the down-sampled signal of the third band is supplied to a function approximation section 21*c* to be function-approximated.

The characteristic of the second modification shown in FIG. 17 lies in the method for extracting the signal of the second band. To be specific, the digital audio signal of the low register range of the first band outputted by the first band separation filter 11*a* and the digital audio signal of the high register range of the third band outputted by the third band separation filter 11*c* are summed by an adder 14*a*. Further, the summed output of the adder 14*a* is supplied to a subtracter 14*b* to be subtracted from the inputted digital audio signal.

Since the signal of the first band (i.e., the low register signal) and the signal of the third band (i.e., the high register signal) are subtracted from the digital audio signal obtained in the terminal 10*a* by performing the aforesaid subtraction process with the subtracter 14*b*, only the signal component of the second band (i.e., the mid register signal) is extracted from the subtracter 14*b*.

Further, the signal of the second band (i.e., the output of the subtracter 14*b*) is down-sampled by a down-sampling section 12*b* and then supplied to a function approximation section 21*b* to be function-approximated.

When being band-divided and function-approximated with a configuration shown in FIG. 17, as the band-divided signals, no overlapped part of signal components will be caused in the end portions of each frequency band, and therefore good band-dividing can be performed.

Next, a third modification of the band separation filter used in the second embodiment of the present invention will be described below with reference to FIG. 18.

Figure 18:
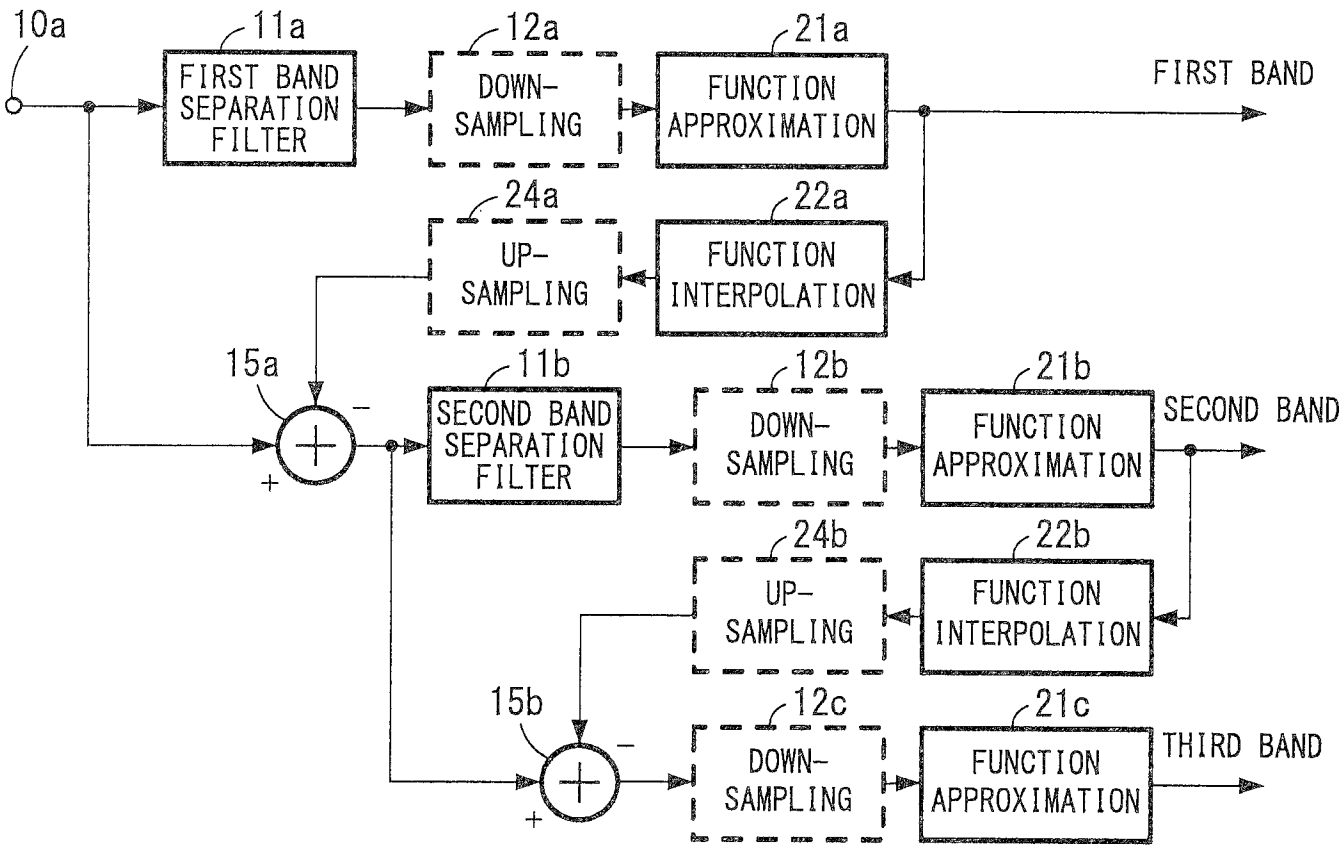
FIG. 18 is a diagram showing a third modification of the band separation filter used in the second embodiment of the present invention.

As shown in FIG. 18, the digital audio signal inputted from a terminal 10*a* is supplied to a first band separation filter 11*a*, where the signal component of a first band is extracted. Further, the signal of the first band is down-sampled by a down-sampling section 12*a* and then function-approximated by a function approximation section 21*a*.

The digital audio signal having been function-approximated by the function approximation section 21*a* is supplied to a function interpolation section 22*a* to be reconstructed into the original digital audio signal, and further, the sampling period of the signal is returned to the original sampling period by an up-sampling section 24*a*. Further, the signal having been returned to the original sampling period is supplied to a subtracter 15*a*.

In the subtracter 15*a*, the digital audio signal outputted by the up-sampling section 24*a* is subtracted from the digital audio signal provided from the terminal 10*a*. Further, the output of the subtracter 15*a* is supplied to a second band separation filter 11*b*, where the signal component of a second band is extracted. The signal of the second band is down-sampled by a down-sampling section 12*b* and then function-approximated by a function approximation section 21*b*.

Similarly, the output of the function approximation section 21*b* is reconstructed as the original digital audio signal by a function interpolation section 22*b*, and further, the reconstructed signal is returned to the original sampling period by an up-sampling section 24*b*. Further, the signal having been returned to the original sampling period is supplied to a subtracter 15*b*.

The digital audio signal up-sampled by the up-sampling section 24*b* is subtracted from the digital audio signal from the subtracter 15*a* by the subtracter 15*b*, and the signal component of the third band is extracted from the output of the subtracter 15*b*. Further, the signal of the third band is down-sampled by a down-sampling section 12*c* and then function-approximated by a function approximation section 21*c*.

When subtracting the signal function-approximated with the circuit configuration shown in FIG. 18 from the original signal, no overlapped part of signal components will be caused in the end portions of each frequency band, and therefore good band-divided signals can be obtained.

Next, a fourth modification of the band separation filter used in the second embodiment of the present invention will be described below with reference to FIG. 19.

Figure 19:
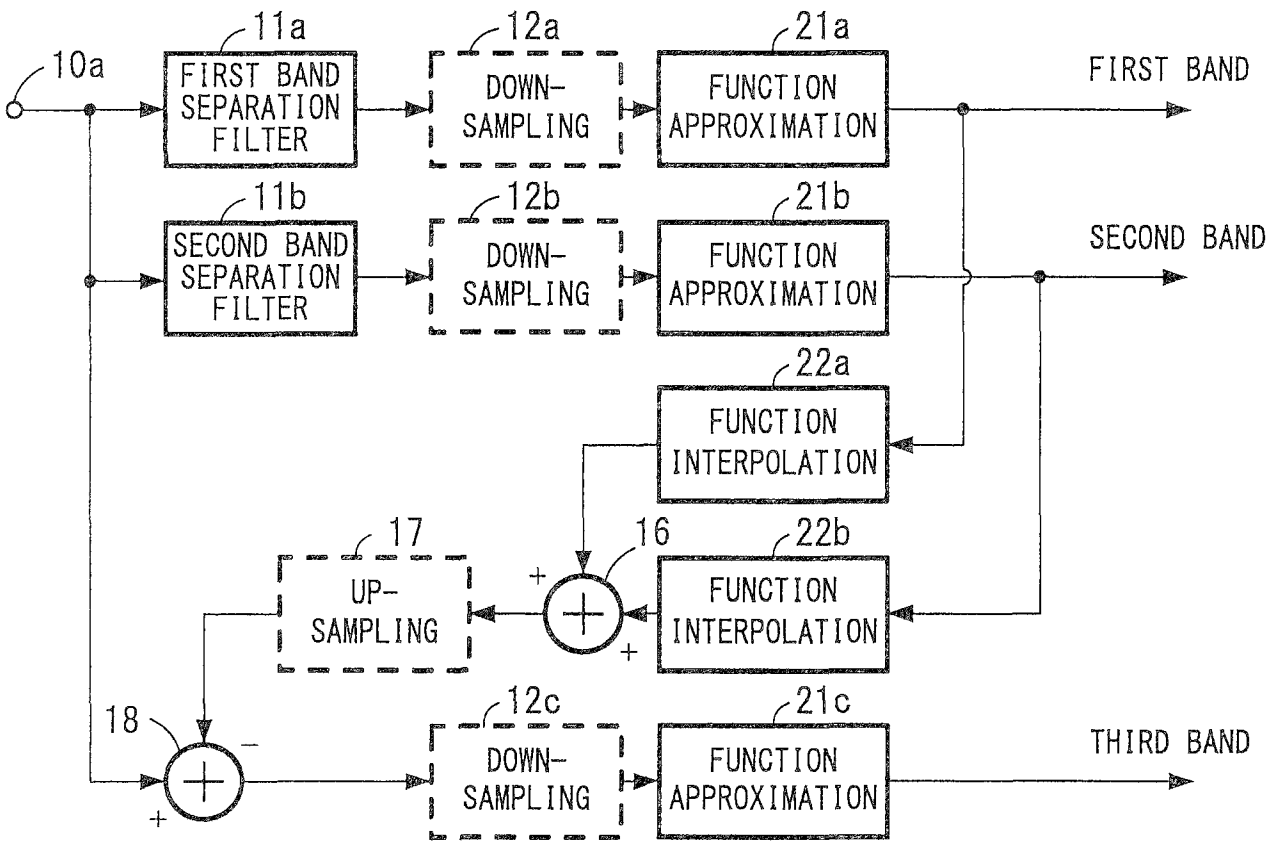
FIG. 19 is a diagram showing a fourth modification of the band separation filter used in the second embodiment of the present invention.

As shown in FIG. 19, the digital audio signal provided from the terminal 10*a* is supplied to a first band separation filter 11*a*, where the signal component of a first band (the low register signal component) is extracted. The signal of the first band is sent to a down-sampling section 12*a* to be down-sampled, and then function-approximated by a function approximation section 21*a*.

Similarly, the digital audio signal provided from the terminal 10*a* is supplied to a second band separation filter 11*b*, where the signal component of a second band (the mid register signal component) is extracted. Further, the signal of the second band is down-sampled by a down-sampling section 12*b* and then function-approximated by a function approximation section 21*b*.

The characteristic of the fourth modification shown in FIG. 19 lies in the method for extracting the signal of the third band. To be specific, the function approximation value of the first band obtained from the function approximation section

21*a* and the function approximation value of the second band obtained from the function approximation section 21*b* are respectively reconstructed by a function interpolation section 22*a* and a function interpolation section 22*b*, and then the reconstructed signals of the two bands are summed by an adder 16. Further, the output of the adder 16 is up-sampled by an up-sampling section 17 and then supplied to a subtracter 18.

Further, in the subtracter 18, the output of the up-sampling section 17 is subtracted from the digital audio signal obtained in the terminal 10*a*. By performing the subtraction, the signal of the first band (i.e., the low register signal) and the signal of the second band (i.e., the mid register signal) are subtracted from the digital audio signal obtained from the terminal 10*a*, and as a result, only the signal component of the third band (i.e., the high register signal) is extracted from the subtracter 18.

Further, the signal of the third band obtained from the subtracter 18 is down-sampled by a down-sampling section 12*c* and then function-approximated by a function approximation section 21*c*.

When function-approximating the signals band-divided by the band-dividing method shown in FIG. 19, as the band-divided signals, no overlapped part of signal components will be caused in the end portions of each frequency band, and therefore good band-divided signals can be obtained.

Incidentally, each of the modifications shown in FIGS. 16 to 19 is explained using an example in which the signal is divided into three bands; however each of the modifications may also be applied to a case where the signal is divided into more bands. In other words, the circuit can be configured so that the signal is divided into four or more bands. Further, the down-sampling section and the up-sampling section are indicated by a broken line in each of the modifications shown in FIGS. 16 to 19, this means that the down-sampling section and the up-sampling section are not indispensable constituent elements of the present invention.

To be specific, the aforesaid embodiments are explained based on a method in which the input signal having been down-sampled is function-approximated and compressed, and up-sampled after function reproduce. However, since the function approximation indicates the interval between extreme values by function, the function approximation itself has down-sampling function, and, since the signal in the interval between extreme values is played by function arithmetic while playing signal, the function approximation itself has up-sampling function. Thus, in the present invention, the down-sampling process and the up-sampling process are not indispensable.

[Description of Third Embodiment]

Next, as a third embodiment of the present invention, an example of dividing the band of an audio signal in unit of "octave" will be described below.

Figure 20:
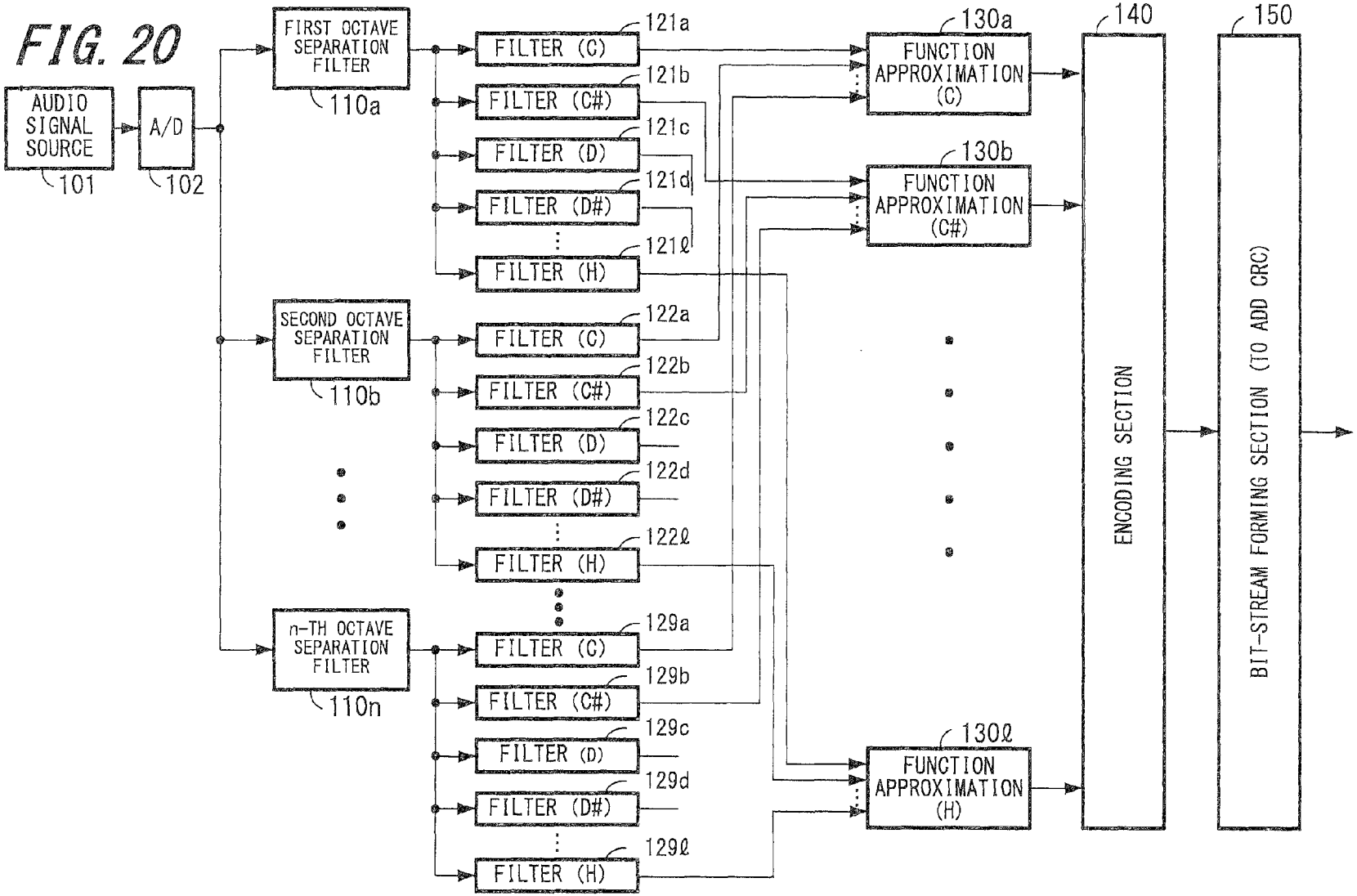
FIG. 20 is a block diagram showing the configuration of an encoding device for dividing the band of an audio signal in unit of "octave" and encoding the signal, according to a third embodiment of the present invention.

FIG. 20 is a block diagram showing entire configuration of a circuit device for dividing the band of an audio signal in unit of "octave". The third embodiment is also similar to the first and second embodiments in many respects; however since the signal is proceeded in unit of "octave" in the third embodiment, the components in FIG. 20 are denoted by different reference numerals from those of FIGS. 1 and 15.

As shown in FIG. FIG. 20, an analog audio signal outputted from an audio signal source 101 is supplied to an analog-to-digital converter 102, where the signal is converted to a digital audio signal by sampling a predetermined number of bits every constant sampling period. The digital audio signal converted by the analog-to-digital converter 102 is an uncompressed digital audio signal.

A configuration for compression-coding the digital audio signal outputted from the digital-to-analog converter 102 and the operation thereof will be described below.

First, the digital audio signal outputted from the digital-to-analog converter 102 is supplied to octave-band separation filters 110*a* to 110*n* (n is an integral number corresponding to octave number). The octave-band separation filters 110*a* to 110*n* are filters adapted to separate the inputted audio signal into signal components of a plurality of different octave-bands. Here, the octave-band means "frequency band of one octave", wherein one octave is referred to as "octave interval" in the western music. If an audio signal with frequency up to 40 kHz, which is twice as broad as the audible band, is divided into each one octave, the audio signal will be separated into about a dozen octave-bands.

The octave-band separation filters 110*a* to 110*n* are, for example, each a basic filter with a sampling function $\psi(k)$ as impulse response function, wherein the sampling function $\psi(k)$ is expressed by a section polynomial.

The signals band-divided by the octave-band separation filters 110*a* to 110*n* are respectively supplied to scale-band separation filters 121*a*-121*l*, 122*a*-122*l*, . . . 129*a*-129*l*, which each separate one octave-band into twelve scales compliant frequency bands.

The twelve scales mentioned here is defined to express an octave interval in a manner in which semitones are included. However, when referring to an octave interval constituting one octave, the tone one octave higher from the fundamental tone is included; while when referring to twelve scales, the tone one octave higher from the fundamental tone is not included. In the description below, when referring to one octave-band, it means a band including twelve scales, and the band of the scale of the tone one octave higher is not included.

The output of the first octave-band separation filter 110*a*, which obviously is an audio signal having a frequency width of one octave, is supplied to the twelve scale-band separation filters 121*a*-121*l* where the signal is separated into frequency components of twelve scales, wherein the center frequencies of the twelve scale-band separation filters 121*a*-121*l* are respectively the frequencies of the twelve scales.

Similarly, the outputs of the 2nd to n-th octave-band separation filters 110*b* to 110*n*, which are each an audio signal having a frequency width of one octave, are respectively supplied to the twelve scale-band separation filters 122*a*-122*l*, . . . 129*a*-129*l*, wherein the center frequencies of the twelve scale-band separation filters 122*a*-122*l*, . . . 129*a*-129*l* are respectively the frequencies of the twelve scales. Further, the audio signal having a frequency width of one octave is separated into the frequency components of the twelve scales, and all octave-bands are broken down into the frequency components of the twelve scales.

In the frequency components of the twelve scales having been broken down in the aforesaid manner, signals of the same scale (i.e., octave signals) are collected for each band, and function approximation is performed by function approximation sections 130*a* to 130*l* on each collection of the components of each scale.

To be specific, twelve function approximation sections 130*a* to 1301 are provided in which: the function approximation section 130*a* performs function approximation on tone C (tone Do), the function approximation section 130*b* performs function approximation on tone C# (tone Do#), the function approximation section 130*c* performs function approximation on tone D (tone Re), the function approximation section 130*d* performs function approximation on tone D# (tone Re#), the function approximation section 130*e* performs function approximation on tone E (tone Mi), the function approximation section 130*f* performs function approximation on tone F (tone Fa), the function approximation section 130*g* performs function approximation on tone F# (tone Fa#), the function approximation section 130*h* performs function approximation on tone G (tone So), the function approximation section 130*i* performs function approximation on tone G# (tone So#), the function approximation section 130*j* performs function approximation on tone A (tone La), the function approximation section 130*k* performs function approximation on tone A#(tone La#), and the function approximation section 1301 performs function approximation on tone B (tone Si).

In the function approximation sections 130*a* to 1301 corresponding to respective scales, a number (n pieces) of audio signals divided by the octave-band separation filters 110*a* to 110*n* are obtained for respective sample points. For example, sample values of n pieces of tone C, each separated from others by an octave, are obtained in the function approximation section 130*a* of tone C (tone Do), and the function approximation process is performed on the sample values of n pieces of tone C. Further, parameters are outputted to an encoding section 140, wherein data amount of the parameters has been reduced by the function approximation. The same process is also performed in other function approximation sections 130*b* to 1301. Since the function approximation performed in the function approximation sections 130*a* to 1301 is identical to that performed in the function approximation sections 21*a* to 21*m* shown in FIGS. 1 and 15, the description thereof will be omitted here.

Herein, the octave and the twelve scales will be described below with reference to FIGS. 21A to 21C.

Figure 21A:
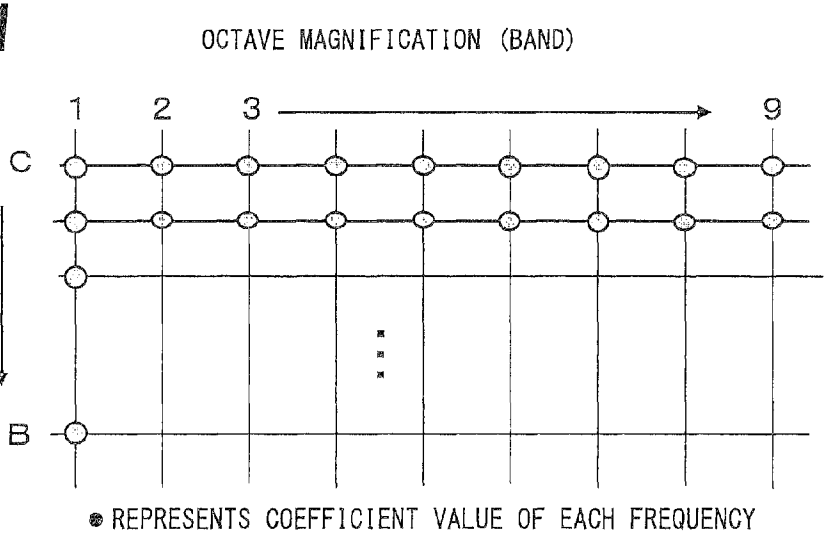
FIGS. 21A to 21C are each a graph for explaining the relationship between twelve-scale data and octave-band (magnification), for explaining the third embodiment of the present invention.

FIG. 21A is a matrix, in which the vertical axis represents data of twelve scales, and the horizontal axis represents octave-band (magnification). Generally, the height of octave is expressed by a value called "note number", and the data of twelve scales is expressed by frequency.

Generally, the audio signal is divided into each octave-band, and the signal of one octave is divided into 2**(k/12) [i.e., (k/12)-th power of 2] pieces of scale data. In other words, when the frequency of a fundamental tone (Do) is "1" and the frequency of a fundamental tone (Do) one octave higher is "2", if dividing the interval between the two fundamental tones (Do) into twelve steps, each step will be divided into (k/12)-th power of 2 (k: 1~12) pieces.

Here, the band-separation for each octave is performed by a trapezoid shaped band separation filter determined by center frequency and bandwidth. For example, if the center frequency $f_n$=369.9944(F#)Hz*2$^n$, the frequency of the lowest tone C within one octave will be $1/\sqrt{2}$ times of the center frequency $f_n$, and the frequency of the highest tone B within one octave will be ∞2 times of the center frequency $f_n$. Thus, the band-dividing process for each octave can be performed under a condition in which the bandwidth is set to: $f_{0n}=f_n/\sqrt{2}\sim f_{11n}=\sqrt{2}f_n$(C~B). In the twelve scales divided in such manner within the band, with respect to the frequency $f_{0n}$ of the lowest tone C within one octave, the frequency $f_{kn}$ of the k-th scale is defined by the following expression:

$$f_{kn}=f_{0n}*2^{(k/12)} \ldots (k=0\text{-}11)$$

In FIG. 21A, the column represents a signal array of twelve scales within one octave, and the row represents a signal array of the same scale for each octave. One tone is one scale thereof, and is also a signal corresponding to any one of nine octaves, and is also a point corresponding to an intersection of the matrix shown in FIG. 21A.

Figure 21B:
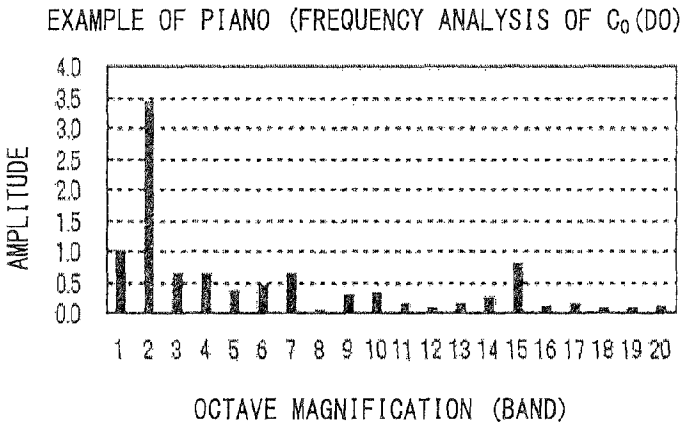
Figure 21C:
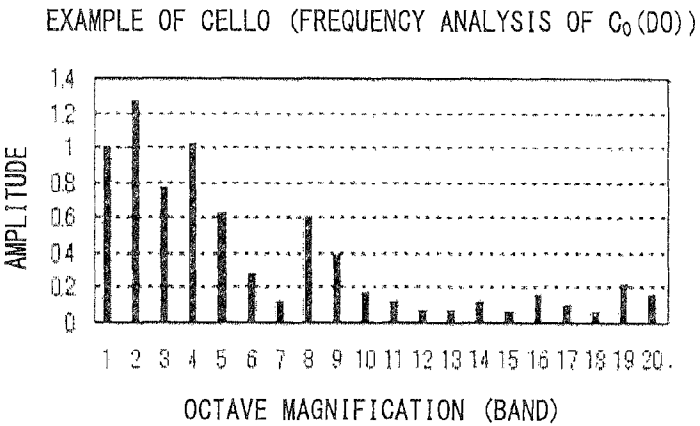

Further, FIG. 21B shows the relationship between the octave magnification (band) and the amplitude when pressing $C_0$ (Do) key of a piano; and FIG. 21C shows the relationship between the octave magnification (band) and the amplitude when drawing $C_0$ (Do) tone of a cello. In the case of a piano, the amplitude is strikingly large in octave magnification 2, and the amplitude is small on average in other octave magnifications. Further, in the case of a cello, when the octave magnification is relatively small, a signal of large amplitude can be obtained in a wide range; and in octave magnifications 10 or larger, the amplitude of signal is small. In other words, characteristics of musical instruments can be faithfully expressed.

Figure 22:
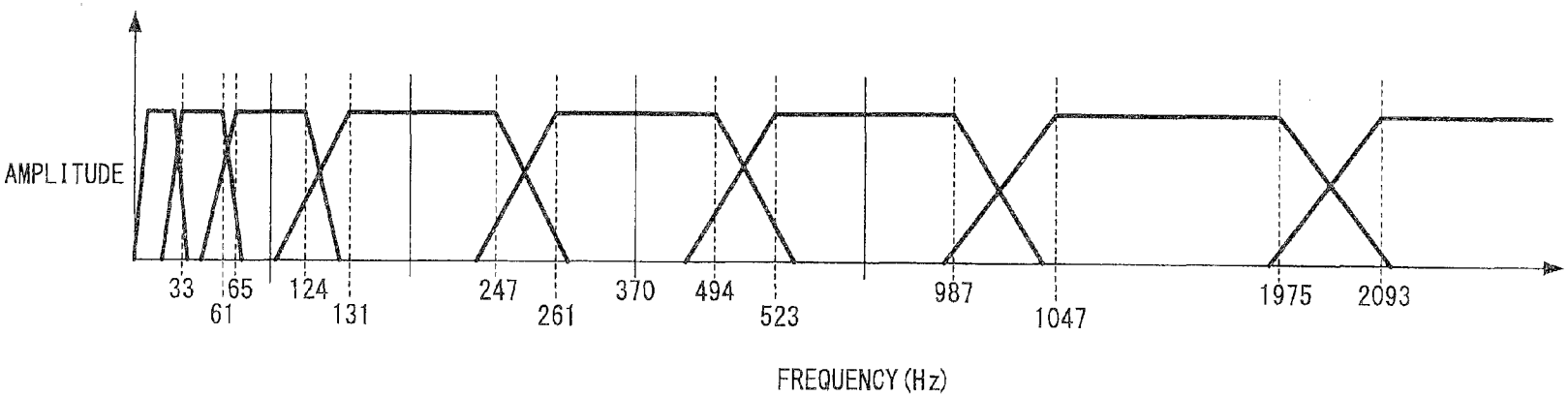
FIG. 22 is a view showing the relationship between scale frequency range and amplitude (i.e., frequency characteristic), in the case where the band separation filter used in the third embodiment of the present invention is configured so as to be divided into each octave frequency interval.

FIG. 22 is a view showing the relationship between the scale frequency range and amplitude (i.e., frequency characteristic), in the case where the band separation filters are configured to divide the signal into each octave frequency interval. As described above, tone can be divided into twelve kinds (scales). The unit of each the divided twelve steps is called a "semitone". In other words, the tone between "Do (C)" and "Do# (C#)", the tone between "Do# (C#)" and "Re (D)", . . . are each called a "semitone".

The frequency of "Do (C4)" is 261 Hz, and the frequency of "Do (C5)", which is one octave higher than "Do (C4)", is 522 Hz. Further, the frequency of "La (A4)" is 440 Hz, and the frequency of "La (A3)", which is one octave lower than "La (A4)", is 220 Hz. As described above, the relationship that one frequency is twice as high as another frequency is called "overtone". Thus, scale frequency is divided into twelve frequencies within one octave, and the octave signal become the same tone every n-times of frequencies.

As shown in FIG. 22, the tones of "Do (C1 to C10)", which have lowest frequency in the twelve scales, are arranged at the left end of each frequency band at 33 Hz, 65 Hz, 131 Hz, 261 Hz, 523 Hz, 1047 Hz, 2093 Hz . . . , so that the overtone relationship is maintained. As shown in FIG. 22, the tones of "Si (B1 to B10)", which have highest frequency in the twelve scales, are arranged at the right end of each frequency band at 61 Hz, 124 Hz, 247 Hz, 494 Hz, 987 Hz, 1975 Hz . . . , so that the overtone relationship is maintained.

Returning to FIG. 20, each signal of the twelve scales having been function-approximated by the function approximation sections 130*a* to 130*l* is sent to the encoding section 140. In the encoding section 140, the parameters of all scale ranges of the twelve scales are encoded, and when performing such encoding process, a variable-length coding may be performed in which bit assignment of the signal of each gradation is determined according to signal condition of each parameter. In the case where the variable-length coding process is performed, information such as bit assignment of each gradation component and the like shall be included as the side information (auxiliary information) of the audio signal. The data encoded by the encoding section 140 is supplied to a bit-stream forming section 150, from which bit-stream data with a predetermined form is outputted.

Further, it is also possible to generate an error detection code and an error correction code in the bit-stream forming section 150 according to necessity, and add the generated error detection code or error correction code to the bit-stream. Thus, the bit-stream data outputted from the bit-stream forming section 150 is either transmitted to the receiving side through, for example, various transmission lines or stored in various storage media. A storage means provided in the encoding device is typically used as the storage media, however other methods may also be used such as transmitting the data to a database of an external device so that the data is stored.

Incidentally, the signals collected from each scale-band separation filter are directly function-approximated in the example shown in FIG. 20, however the present invention also include a configuration in which a down-sampling process is performed to thin out the sampling period of the signals collected from each scale-band separation filter, and then the function approximation process is performed on the down-sampled signals. By performing down-sampling, amount of data of the audio signal after compression can be effectively reduced.

An example of a device for decoding the signal encoded by the encoding device shown in FIG. 20 will be described below with reference to FIG. 23.

Figure 23:
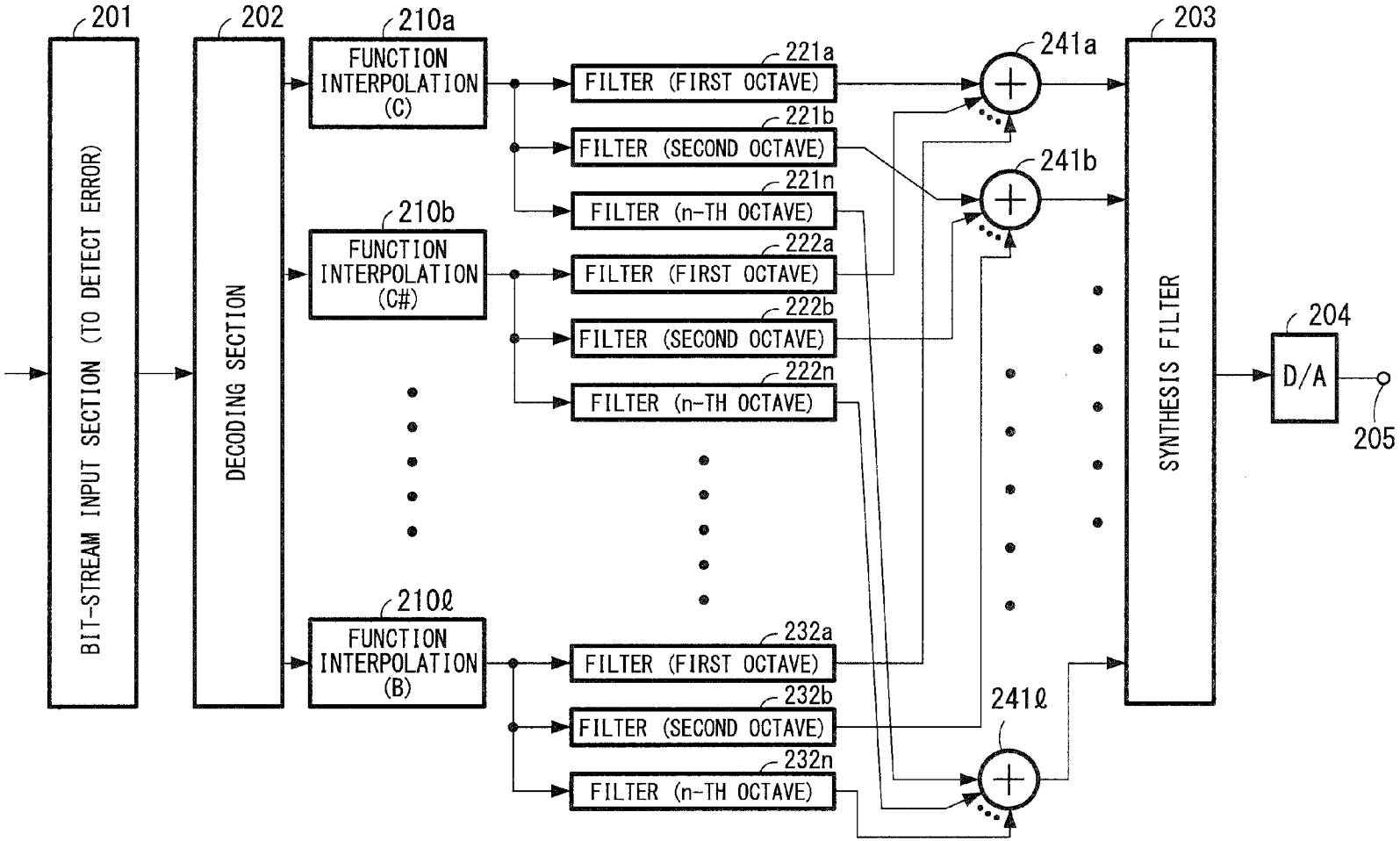
FIG. 23 is a block diagram showing the configuration of a decoding device adapted to decode the signal encoded by the encoding device shown in FIG. 20.
Figure 24:
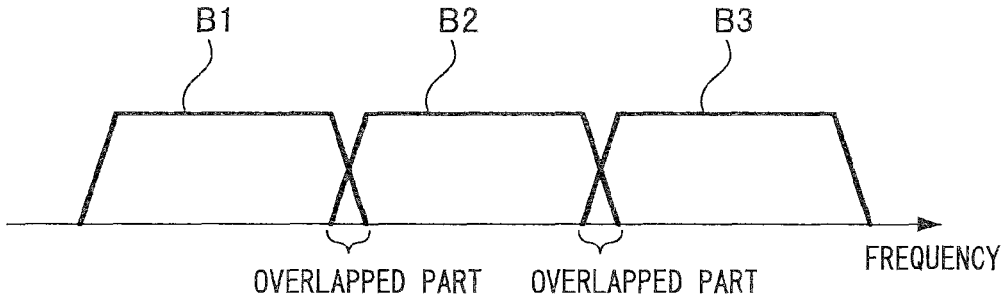
FIG. 24 is a view for explaining band-dividing according to a prior art.

As shown in FIG. 23, the encoded bit-stream is supplied to a bit-stream input section 201. The error detection code or error correction code has been attached to the bit-stream, and in the bit-stream input section 201, an error detection process or an error correction process is performed using the attached error detection code or error correction code.

Further, the encoded data of the function-approximated parameters of the bit-stream having been subjected to the error detection process or error correction process is supplied to a decoding section 202, where the parameters are decoded for each separated band.

The parameters of each band decoded by the decoding section 202 are supplied to function interpolation sections 210*a* to 210*l*. There are twelve (twelve scales) function interpolation sections 210*a* to 210*l* provided corresponding to the function approximation sections 130*a* to 130*l* of twelve scales on the side of the encoding device shown in FIG. 20 to perform a process inverse to the approximation process performed by the function approximation sections 130*a* to 130*l*. Further, the values of the sample points of each twelve scales octave are reconstructed.

Here, only the signals of the scale bands assigned to each of the function interpolation sections 210*a* to 210*l* are included in the output of each of the function interpolation sections 210*a* to 210*l* with the interval of one octave. The output of each of the function interpolation sections 210*a* to 210*l* is supplied to n filters that separate the output for each one octave component.

To be specific, the output of the collection of the band of the scale of the tone C (Do) reconstructed by the function interpolation section 210*a* is supplied to n octave-band separation filters 221*a* to 221*n*. Further, the signal of the band of the scale of the tone C (Do) of a first octave-band is extracted by the octave-band separation filter 221*a*, and the signal of the band of the scale of the tone C (Do) of a second octave-band is extracted by the octave-band separation filter 221*b*. The same process is performed by each of the other filters, so that the signals of the tones C (Do) with the interval of one octave are separated for each one octave.

Similarly, the output of the collection of the band of the scale of the tone C# reconstructed by the function interpolation section 210*b* is supplied to n octave-band separation filters 222*a* to 222*n*, so that the signals of the tones C# with the interval of one octave are separated for each one octave. Such process is performed on the reconstructed signal of the band of each of the twelve scales. FIG. 23 shows an example in which the output of the collection of the band of the scale of the tone C# is supplied to n octave-band separation filters 232*a* to 232*n*, so that the signals are separated for each one octave.

Further, the signals of each band separated by each of octave-band separation filters 221*a* to 221*n*, 222*a* to 222*n*, . . . , 232*a* to 232*n* are collected in adders 241*a* to 241*l*, which are individually provided for each octave-band, to be summed, and an audio signal of the band of one octave is reconstructed by each adder, so that signals of bands of n octaves are obtained.

Further, the signals of bands of n octaves obtained by the adders 241*a* to 241*l* are synthesized by a synthesis filter 203 so as to obtain a digital audio signal of one system.

Incidentally, the aforesaid example gives a method of reconstructing data for each octave signal, and the method is configured to make it possible to adjust the gain for each band in the case where the audience has a hearing problem or the like. Thus, the reconstructing process is a summation operation for each band; for a normal person, each output of the function interpolation sections 210*a* to 210*l* is directly supplied to the synthesis filter 203, and it is not necessary to collect the signals in unit of octave.

The digital audio signal outputted from the synthesis filter 203 is supplied to a digital-to-analog converter 204, and the analog audio signal converted by the digital-to-analog converter 204 is outputted to an analog audio signal output terminal 205.

Thus, by performing a decoding process, which is a process inverse to the encoding process, it is possible to perform a decoding process to well reconstruct the original audio signal.

In order to sequentially show the decoding process, in the configuration example shown in FIG. 23, the band of each scale is obtained by each of the octave-band separation filters 221*a* to 221*n*, 222*a* to 222*n*, . . . , 232*a* to 232*n*, and the signals of the bands of the same scale (for example, C (Do)) from each of the octave-band separation filters are summed by the adders 241*a* to 241*l* so as to obtain the signals for each one octave. Further, the signals from the adders 241*a* to 241*l* are synthesized, and the synthesized signal is supplied to the digital-to-analog converter 204. However, it is also possible to directly synthesize the output of each of the octave-band separation filters 221*a* to 221*n*, 222*a* to 222*n*, . . . , 232*a* to 232*n* for each scale (for example, C (Do)) with twelve synthesis filters, without summing the output of each of the octave-band separation filters 221*a* to 221*n*, 222*a* to 222*n*, . . . , 232*a* to 232*n* with the adders 241 to 241*l*. With such a configuration, as shown in FIG. 21B and FIG. 21C, the sound sources extracted using the frequency characteristics of each musical instrument can be effectively classified.

Incidentally, the aforesaid embodiments are described based on the examples in which the encoding configuration and decoding configuration are respectively configured by dedicated devices having the means adapted to perform the corresponding signal processes; however the present invention also includes a configuration in which a program (software) for executing signal processes corresponding to the processes performed by the encoding section and decoding section described in the aforesaid embodiments is installed on an information-processing device, such as a personal computer for performing various kinds of data processing, and the same encoding process and decoding process are performed by the software process by executing the program. The program may either be distributed through various kinds of recording media, or via a transmission medium such as the Internet.

Industrial Applicability

The compression and reproduce technique of the audio signal about the present invention has been described in details. The technical feature of the present invention lies in that the compression and reproduce can be freely performed according to height of tone (register). Obviously, such technical feature can be used not only to distribute music to an audio device or over a network, but also to broadcast guidance information in a loud environment, to form a spiritually comfortable environment such as BGB, and the like. Particularly, the technique of the present invention is very useful to hearing aid users such as elderly people and person with hearing loss having problems in discerning high pitched tone and low pitched tone.

EXPLANATION OF REFERENCE NUMERALS

1, 101 audio signal source
2, 102 analog-to-digital converter
3, 140 encoding section
4, 150 bit-stream forming section
5 side information encoding section
10 filter bank
11*a*~11*m* bandpass filter
12*a*~12*m* down-sampling section
20 function approximation section (21*a*-21*m:* function approximation section (for each band))
31*a*~31*m* quantization bit assignment section
51 bit-stream input section
52 decoding section
53*a*~53*m* inverse quantization section
22*a*, 22*b*, 54*a*~54*m* function interpolation section
56 digital-to-analog converter
57 analog audio signal output terminal
60 filter bank
24*a*, 24*b*, 61*a*~61*m* up-sampling section
62 sub-band synthesis filter
110*a*~110*n* octave separation filter
121*a*~121*l*, 122*a*~122*l*, 129*a*~129*l* separation filters for twelve scales
130*a*~130*l* function approximation sections of twelve scales

The invention claimed is:

1. An audio signal compression device comprising:

a band dividing means adapted to divide a digital audio signal into a plurality of frequency bands;

a function approximation means prepared for each divided band and adapted to function-approximate a predetermined interval of the digital audio signal, which has been divided into each band by the band dividing means, using an n-degree polynomial, wherein n is an integral number equal to or more than 2; and an encoding means adapted to encode parameters which are coefficient values of the n-degree polynomial having been function-approximated by the function approximation means, wherein the n-degree polynomial is expressed by a linear combination expression of sampling functions classified by number of times at which the function is differentiable.

2. The audio signal compression device according to claim 1, wherein the sampling function used in the function approximation means is a function including a fundamental term and a control term expressed separately from each other, and the characteristic of the sampling function is changed by setting a coefficient value of the control term.

3. The audio signal compression device according to claim 1, wherein the band dividing means includes:

a first band separation filter adapted to separate a low register signal, which is a first frequency band, from the inputted digital audio signal;

a third band separation filter adapted to separate a high register signal, which is a third frequency band, from the inputted digital audio signal;

an addition means adapted to sum the low register signal of the first frequency band separated by the first band separation filter and the high register signal of the third frequency band separated by the third band separation filter; and a subtraction means adapted to subtract the summed signal of the low register signal of the first frequency band and the high register signal of the third frequency band summed by the addition means from the inputted digital audio signal, and wherein a mid register signal, which is a second frequency band, is separated from the subtracted output of the subtraction means.

4. The audio signal compression device according claim 1, wherein the band dividing means includes:

a first band separation filter adapted to separate the signal of a first frequency band of the inputted digital audio signal;

a first subtraction means adapted to subtract a signal obtained by function-approximating, with the function approximation means, the signal of the first frequency band separated by the first band separation filter and then function-interpolating the function-approximated signal from the inputted digital audio signal;

a second band separation filter adapted to separate the signal of a second frequency band from the output of the first subtraction means; and a second subtraction means adapted to subtract a signal obtained by function-approximating, with the function approximation means, the signal of the second frequency band separated by the second band separation filter and then function-interpolating the function-approximated signal from the output signal of the first subtraction means, and wherein the signal of a third frequency band is separated from the output of the second subtraction means.

5. The audio signal compression device according to claim 1, wherein the band dividing means includes:

a first band separation filter adapted to separate the signal of a first frequency band from the inputted digital audio signal;

a second band separation filter adapted to separate the signal of a second frequency band from the inputted digital audio signal;

an addition means adapted to sum a first signal and a second signal, wherein the first signal is obtained by function-approximating the signal of the first frequency band separated by the first band separation filter and then function-interpolating the function-approximated signal, and the second signal is obtained by function-approximating the signal of the second frequency band separated by the second band separation filter and then function-interpolating the function-approximated signal; and a subtraction means adapted to subtract the output of the addition means from the inputted digital audio signal, and wherein the signal of a third frequency band is separated from the output of the subtraction means.

6. The audio signal compression device according to claim 1, wherein the band dividing means includes:

a plurality of octave separation filters adapted to separate the digital audio signal into each octave frequency band; and scale-component separation filters adapted to separate the digital audio signal of each one octave band separated by the plurality of octave separation filters into twelve scales compliant bands corresponding to twelve scales, wherein the digital audio signal is separated in a unit of the scale frequency.

7. The audio signal compression device according to claim 6, wherein the octave separation filter is a bandpass filter whose center frequency is the center scale frequency of a predetermined one octave scale and whose bandwidth is between a lowest band frequency and a highest band frequency, wherein the lowest band frequency is $1/\sqrt{2}$ times of the center scale frequency and the highest band frequency is $\sqrt{2}$ times of the center scale frequency.

8. The audio signal compression device according to claim 6, wherein the scale-component separation filters each separate the digital audio signal outputted from one octave separation filter into "(k/12)-th power of 2", wherein k=0~11, times of the lowest band frequency of a predetermined one octave scale.

9. The audio signal compression device according to claim 6, further comprising:

a plurality of function approximation means adapted to input the signals in unit of the scale frequency separated by the scale-component separation filters, collect the same scale of the twelve scales compliant bands from a plurality of octaves separated by the octave separation filters to obtain a collection of a band corresponding to the same scale, and function-approximate the collection of the band corresponding to the same scale by an n-degree polynomial, wherein n is an integral number equal to or more than 2 ; and a compression-coding means adapted to compression-code the signals from the plurality of function approximation means.

10. An audio signal compression device comprising:

a band dividing means adapted to divide a digital audio signal into a plurality of frequency bands;

a function approximation means prepared for each divided band and adapted to function-approximate a predetermined interval of the digital audio signal, which has been divided into each band by the band dividing means, using an n-degree polynomial, wherein n is an integral number equal to or more than 2;

an encoding means adapted to encode parameters which are coefficient values of the n-degree polynomial having been function-approximated by the function approximation means; and a down-sampling means adapted to thin out a sampling period of the digital audio signal divided into each band by the band dividing means, wherein the function approximation means function-approximates the digital audio signal whose sampling period has been thinned out by the down-sampling means.

11. An audio signal compression device comprising:

a band dividing means adapted to divide a digital audio signal into a plurality of frequency bands;

a function approximation means prepared for each divided band and adapted to function-approximate a predetermined interval of the digital audio signal, which has been divided into each band by the band dividing means, using an n-degree polynomial, wherein n is an integral number equal to or more than 2; and an encoding means adapted to encode parameters which are coefficient values of the n-degree polynomial having been function-approximated by the function approximation means, wherein, the band dividing means has an i-th, wherein i=1~n, subtraction means adapted to subtract the output signal of an i-th band separation filter from the inputted digital audio signal, the i-th separation filter being adapted to separate the signal of an i-th frequency band, and wherein the subtracted output of the i-th subtraction means is used as input signal of an (i+1)-th band separation filter to separate and output the signal of an (i+1)-th frequency band, and the signal of an n-th frequency band is separated and outputted from the subtracted output of an n-th subtraction means.

12. An audio signal compression method comprising the step of:

dividing an inputted digital audio signal into a plurality of frequency bands with band separation filters;

function-approximating an arbitrary interval of the digital audio signal, which has been divided into the plurality of frequency bands, for each divided band using an n-degree polynomial, wherein n is an integral number equal to or more than 2;

encoding parameters of the function having been function-approximated for each band; and performing a down-sampling process to thin out a sampling period of the digital audio signal divided into each band, wherein the function approximation is performed on the digital audio signal whose sampling period has been thinned out by the down-sampling process.

13. An audio signal compression method according to claim 12, wherein the step of dividing the inputted digital audio signal into the plurality of frequency bands with the band separation filters comprises:

a first band-separating process step of separating the signal of a first frequency band of the inputted digital audio signal;

a first subtraction process step of subtracting a signal, which is obtained by function-approximating, with the function approximation means, the signal of the first frequency band separated by the first band-separating process and then function-interpolating the function-approximated signal, from the inputted digital audio signal;

a second band-separating process step of separating the signal of a second frequency band from the output obtained by performing the first subtraction process; and a second subtraction process step of subtracting a signal, which is obtained by function-approximating the signal of the second frequency band separated by the second band-separating process and then function-interpolating the function-approximated signal, from the signal obtained by performing the first subtraction process, wherein the signal of a third frequency band, which is different from the first and second frequency bands, is separated by performing the second subtraction process.

14. An audio signal compression method according to claim 12, wherein the step of dividing the inputted digital audio signal into the plurality of frequency bands with the band separation filters comprises:

a first band-separating process step of separating the signal of a first frequency band of the inputted digital audio signal;

a second band-separating process step of separating the signal of a second frequency band of the inputted digital audio signal;

an addition process step of summing a first signal and a second signal, wherein the first signal is obtained by function-approximating the signal of the first frequency band separated by the first band-separating process and then function-interpolating the function-approximated signal, and the second signal is obtained by function-approximating the signal of the second frequency band separated by the second band-separating process and then function-interpolating the function-approximated signal; and a subtraction process step of subtracting the output signal summed by the addition process from the inputted digital audio signal, wherein the signal of a third frequency band, which is different from the first and second frequency bands, is separated by performing the subtraction process.

15. An audio signal compression method comprising the steps of:

dividing an inputted digital audio signal into a plurality of frequency bands with band separation filters;

function-approximating an arbitrary interval of the digital audio signal, which has been divided into the plurality of frequency bands, for each divided band using an n-degree polynomial, wherein n is an integral number equal to or more than 2; and encoding parameters of the function having been function-approximated for each band, wherein the step of dividing the inputted digital audio signal into the plurality of frequency bands with the band separation filters comprises:

a first band-separating process step of separating the signal of a first frequency band from the inputted digital audio signal;

a first subtraction process step of subtracting the digital audio signal of the first frequency band separated by the first band-separating process from the inputted digital audio signal;

a second band-separating process step of separating the signal of a second frequency band from the signal obtained by performing the first subtraction process; and a second subtraction process step of subtracting the digital audio signal of the second frequency band separated by the second band-separating process from the inputted digital audio signal, wherein the digital audio signal of a third frequency band, which is different from the first and second frequency bands, is band-separated by performing the second subtraction process.

16. An audio signal compression method comprising the steps of:

dividing an inputted digital audio signal into a plurality of frequency bands with band separation filters. function-approximating an arbitrary interval of the digital audio signal, which has been divided into the plurality of frequency bands, for each divided band using an n-degree polynomial, wherein n is an integral number equal to or more than 2; and encoding parameters of the function having been function-approximated for each band, wherein the step of dividing the inputted digital audio signal into the plurality of frequency bands with the band separation filters comprises:

a first band-separating process step of separating a low register signal, which is a first frequency band, from the inputted digital audio signal;

a second band-separating process step of separating a high register signal, which is a third frequency band, from the inputted digital audio signal;

a addition process step of summing the low register signal, which is the first frequency band, separated by the first band-separating process and the high register signal, which is the third frequency band, separated by the second band-separating process; and a subtraction process step of subtracting the summed signal of the low register signal of the first frequency band and the high register signal of the third frequency band from the inputted digital audio signal, wherein a mid register signal, which is a second frequency band of the inputted digital audio signal, is separated by the subtraction process.

* * * * *